US012571211B1

(12) United States Patent
Record

(10) Patent No.: US 12,571,211 B1
(45) Date of Patent: Mar. 10, 2026

(54) WALL BUILDING SYSTEM

(71) Applicant: Scott Record, Twin Falls, ID (US)

(72) Inventor: Scott Record, Twin Falls, ID (US)

( * ) Notice: Subject to any disclaimer, the term of this patent is extended or adjusted under 35 U.S.C. 154(b) by 0 days.

(21) Appl. No.: 19/342,908

(22) Filed: Sep. 29, 2025

Related U.S. Application Data

(63) Continuation-in-part of application No. 19/056,291, filed on Feb. 18, 2025, now Pat. No. 12,454,826.

(51) Int. Cl.

| | |
|---|---|
| ***E04C 2/52*** | (2006.01) |
| ***E04B 5/02*** | (2006.01) |
| ***E04B 7/22*** | (2006.01) |
| ***E04D 3/35*** | (2006.01) |
| *E04C 2/00* | (2006.01) |

(52) U.S. Cl.
CPC ..... *E04C 2/521* (2013.01); *E04B 7/22* (2013.01); *E04C 2/50* (2013.01); *E04D 3/352* (2013.01); *E04C 2002/004* (2013.01)

(58) Field of Classification Search
CPC ..... E04C 2/521; E04C 2/50; E04C 2002/00; E04B 7/22; E04D 3/352
USPC ..... 52/300, 721, 712, 702, 79.1, 299, 296, 52/289, 293.1, 262, 264; 248/226.11
See application file for complete search history.

(56) References Cited

U.S. PATENT DOCUMENTS 3,640,039 A * 2/1972 McKee ..... E04B 1/6158 52/396.04
3,992,839 A * 11/1976 La Borde ..... E04B 2/721 52/592.1
4,777,774 A * 10/1988 Smalley, III ..... E04B 2/72 52/282.3
5,706,620 A * 1/1998 De Zen ..... H02G 3/286 52/270
5,974,751 A * 11/1999 De Zen ..... E04B 2/8629 52/439
6,250,862 B1 6/2001 Dunmire
6,591,558 B1 * 7/2003 De Zen ..... E04C 2/20 52/91.1
7,107,731 B2 9/2006 Record
7,797,897 B2 * 9/2010 Roth ..... E04B 1/12 52/270
7,895,802 B2 3/2011 Kurz
8,650,820 B2 2/2014 Bocquet
8,677,713 B1 * 3/2014 Sheehy ..... E04C 2/388 52/286
10,123,456 B2 11/2018 Evans et al.
10,287,773 B2 * 5/2019 Taleb ..... E04B 2/8629
(Continued)

*Primary Examiner* — Babajide A Demuren

(57) ABSTRACT

A wall building system includes panels for walls, floors, ceilings, roofs, eaves, and lofts that positively couple together via one or more couplers. The panels may include an insulating core. The one or more couplers incorporate features for receiving plumbing, vents, drains, electrical, coax, CAT5, HVAC, and any other utilities or technology. The panels are designed such that the utilities are concealed until an electrical outlet, drain or water is required, at which time the panel is cut to expose the one or more couplers, which are subsequently cut to reveal a hollow cavity within. The system is aesthetically pleasing and reduces construction time considerably. The system is also extremely energy efficient, fireproof, soundproof, insect proof, virus proof, resists hurricane force winds, is EMP proof, fallout proof, can support a heavy snow load, and is faster to build with and structurally stronger than other construction methods.

17 Claims, 21 Drawing Sheets

(56) References Cited

U.S. PATENT DOCUMENTS

| | | | | |
|---|---|---|---|---|
| 11,629,493 | B2 * | 4/2023 | Livingstone | E04C 2/48<br>52/91.3 |
| 12,454,826 | B1 * | 10/2025 | Record | E04C 2/284 |
| 2002/0069600 | A1 * | 6/2002 | Bryant | E04B 7/20<br>52/794.1 |
| 2003/0196567 | A1 * | 10/2003 | Norton | B61D 17/045<br>105/396 |
| 2004/0134162 | A1 * | 7/2004 | Douglas | E04B 1/12<br>52/741.1 |
| 2014/0102556 | A1 * | 4/2014 | Malpas | H02S 20/23<br>137/360 |

* cited by examiner

WALL BUILDING SYSTEM

CROSS-REFERENCE TO RELATED APPLICATIONS

This application is a continuation-in-part of U.S. Non-Provisional patent application Ser. No. 19/056,291 filed on Feb. 18, 2025, which is incorporated herein by reference.

TECHNICAL FIELD

This invention relates to a system used for building construction. More particularly, this system relates to a system for factory-built houses or small buildings that can be customizable and exhibit drastically improved strength, weight, and thermal efficiency characteristics.

BACKGROUND

For over 20 years, commercial and residential construction companies have been utilizing panelized wall systems. These panelized wall systems were created to solve many of the issues and delays that are often present in traditionally built buildings. That is, buildings built with wood or steel frames. Pre-manufactured building components, such as panels, are used for walls, roofs, floors, and other building components. Premanufactured building components are desirable because they greatly decrease the time and expense involved in construction. Pre-manufactured building components for structural-load-bearing panels must comply with building codes such as axial load-bearing, shear and racking strengths, and total component weight. Additional criteria may affect specifications including fire resistance, thermal insulation efficiency, sound abating, water and insect resistance. In addition, pre-manufactured components are readily transportable, efficiently packaged, and easily handled. However, even with the many advancements in these systems, there are still many shortcomings that cannot or have not been addressed, thereby creating numerous deficiencies in these systems.

Deficiencies that are prevalent in these systems include, but are not limited to, the following: (1) no way to be put together efficiently and quickly, requiring adhesives and cure time; (2) issues due to variabilities in installation from one employee to another; (3) no instant positive locking mechanism to connect each wall panel; and (4) the lack of being able to seamlessly carry utilities while also concealing their presence.

Furthermore, pre-manufactured components for building construction have been manufactured out of a variety of materials. A common component is a laminated or composite panel. One such composite panel includes a core material of polystyrene foam positioned between wood members, and the combination is fixed together by nails, screws, or adhesives. These wood composite panels suffer from the disadvantage of being highly combustible and not mechanically stable enough for many construction applications. In addition, these wood composite panels are subject to rot, decay, and insect attack. Accordingly, wood composite panels are not deemed satisfactory for a large cross-section of modern building applications. In one variation of the wood-composite building panel, a laminated skin is fixed to the outside wood members. These panels with the laminated skin are more expensive to manufacture while suffering from the same inadequacies as the panels without the laminated skins.

Accordingly, there is a need for a wall system that is simple and efficient to use and that couples together easily, while maintaining strength, fire resistance, and other advantageous qualities. The present invention seeks to solve these and other problems.

SUMMARY OF EXAMPLE EMBODIMENTS

In one embodiment, a wall building system includes removably attachable wall panels and one or more couplers (e.g., keys and extensions) that facilitate the coupling of the removably attachable wall panels. The wall panels and one or more couplers may include an insulating core. The wall panels and/or the one or more couplers may include an outer covering. The one or more couplers may include standard key couplers, corner couplers, T-shaped couplers, second T-shaped couplers, plus-shaped couplers, first extensions, and second extensions. It will be appreciated that the one or more couplers may each include cavities that are placed within and/or created at a junction where the panels couple to the one or more couplers. The cavities can house utilities, such as electrical wiring and data cables, contributing to the seamless, concealed look of the wall system. Further, the system may include vents placed in the one or more couplers and/or panels, wire positionable in the cavities, a sealing component (rods, adhesives in liquids or solids, etc.) positioned in the cavities, and rods positioned on the cavities.

The wall building system is directed toward structural building components that overcome drawbacks experienced by other building components and exhibits greater structural capacity while being easier and less expensive to manufacture.

DETAILED DESCRIPTION OF EXAMPLE EMBODIMENTS

Figure 1:
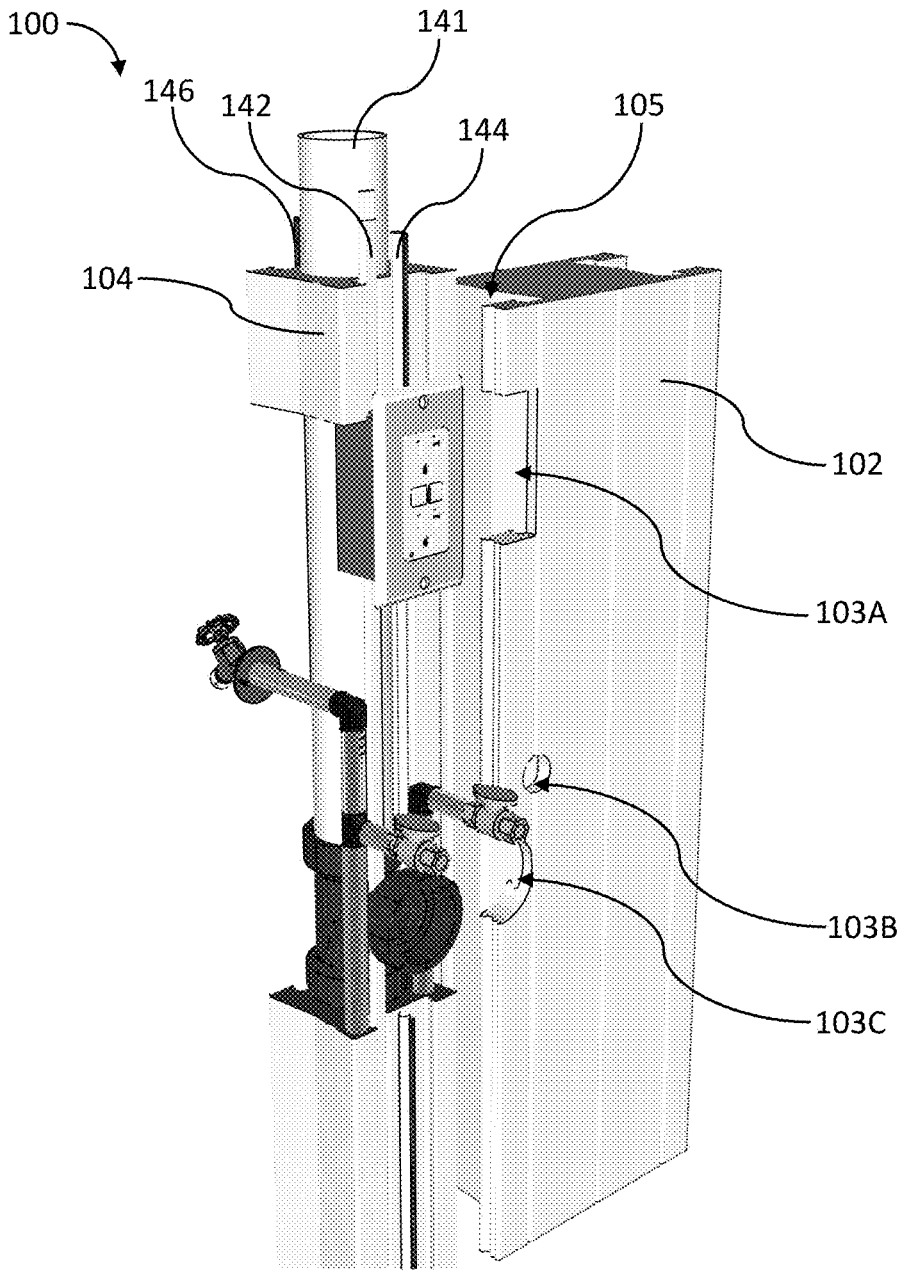
FIG. 1 illustrates a side perspective view of a wall building system.
Figure 2:
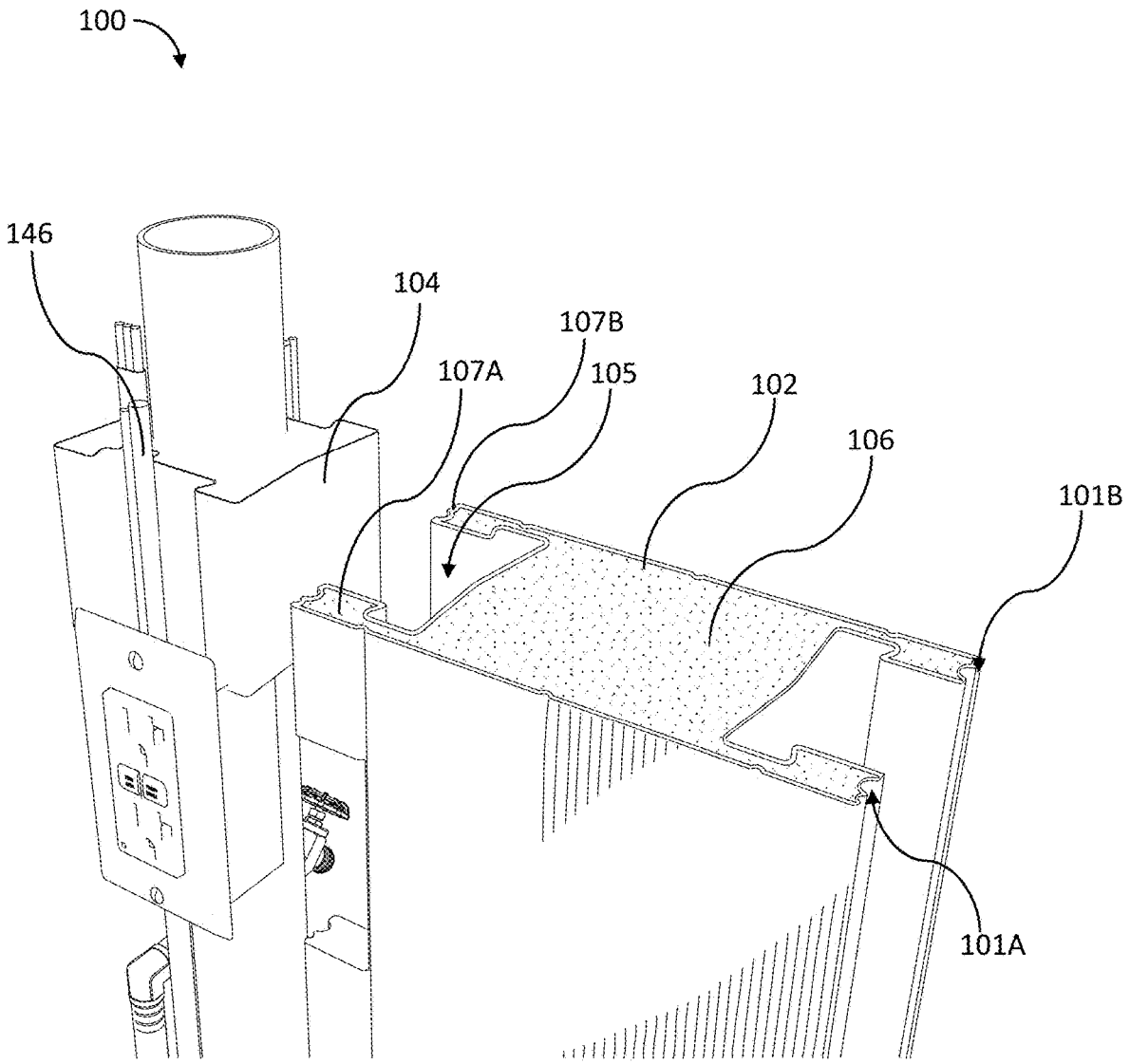
FIG. 2 illustrates a perspective view of a wall building system.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

It will be understood that the detailed description depicts only example embodiments, which are not to be considered limiting in scope. Reference to the invention, the present disclosure, or the like are not intended to restrict or limit the invention, the present disclosure, or the like to exact features or steps of any one or more of the exemplary embodiments disclosed herein. References to "one embodiment," "an embodiment," "various embodiments," and the like, may indicate that the embodiment(s) so described may include a particular feature, structure, or characteristic, but not every embodiment necessarily includes the particular feature, structure, or characteristic. In addition, repeated use of the phrase "in one embodiment," or "in an embodiment," do not necessarily refer to the same embodiment, although they may refer to the same embodiment.

The particular arrangements disclosed herein are meant to be illustrative only and not limiting as to the scope of the invention. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described.

It will be understood that the steps of any such processes or methods are not limited to being carried out in any particular sequence or arrangement. In fact, the steps of the disclosed processes or methods generally may be carried out in various different sequences and arrangements while still falling within the scope of the present invention.

The terms "comprising," "including," "having," and the like, as used with respect to embodiments, are synonymous, and are generally intended as "open" terms.

As previously discussed, there is a need for a wall system that is simple and efficient to use and that couples together easily, while maintaining strength, fire resistance, and other advantageous qualities. The present invention seeks to solve these and other problems.

As shown in FIGS. 1-5, in one embodiment, a wall building system 100 includes removably attachable wall panels 102 ("wall panels" or "panels") and one or more couplers 104 (e.g., keys and extensions) that facilitate the coupling of the removably attachable wall panels 102. When the panels 102 and the one or more couplers 104 are attached to each other, the connection is secure to the point of withstanding natural disasters and even explosions. The wall panels 102 may be used in the construction of wall, floors, and roofs and coupled together without tools. The wall panels 102 and one or more couplers 104 may include an insulating core 106, such as polyurethane (PU) as a primary filler. In some embodiments, the wall panels 102 and the one or more couplers 104 may include "Polyisocyanurate" (PIR) due to its superior fire resistance capabilities, structural integrity, and better thermal characteristic. Other insulating cores known in the art may be used herein. The wall panels 102 and/or the one or more couplers 104 may include an outer covering. The outer covering may include extruded aluminum, plastic, sheetrock, wood, roll-formed, etc. The outer covering would be present on the exterior and/or interior of the wall panel, and may be filled with polyurethane or other material as previously discussed. In some embodiments, the exterior side of the outer covering may be different than the material on the interior side of the outer covering, or both may be the same material.

Each end of the wall panels may include a recessed portion 105 with a first finger 107A and a second finger 107B, all of which interact with and couple, are removably attachable, to the one or more couplers 104. The first and second fingers 107A, 107B may each include first depressions 101A, second depressions 101B that are smaller than the first depressions 101A, and third depressions 101C. These depressions may mate with other depressions on other first and second fingers and the couplers 104, when the couplers 104 are employed, to create cavities discussed hereinafter. The panels 102 may include a variety of apertures 103A, 103B (e.g., circular and square-shaped) that are cut into the panels 102 based on the desired location of pipes, electrical boxes, etc. Some of these apertures may include wings in conjunction with the one or more can be cut to accommodate the precise diameter of hole required for the ABS. These wings are on all panels, and will allow for placement on either the interior or exterior of virtually any configuration of electric boxes on any panel. Another aperture 103C on the panel 102 may be about 50% on one side of the panel, and 50% on the other side of the panel 102. The radius of the wall panels 102 allows for precise placement of a drill or laser that pilots the aperture saw, allowing for the precise placement of the aperture, eliminating the requirement for more complex fixturing.

The wall panels 102 may have a first side, a second side opposite the first side, and the insulating core thereinbetween. The first and second sides may be symmetrical, thereby allowing the user to manipulate the panel 102 180 degrees on either the horizontal or vertical axis and have the same results. While the first and second sides are the same, each of the panels 102 are symmetrical from one end to the other and top to bottom. It will be appreciated that during manufacturing, if it is needed to cut a panel, the waste from the one side can be used in another area. If there were a small dent, for instance, in a wall that was facing to the exterior, that wall panel could be turned around, and that small dent would be concealed by a cabinet, saving the cost, enhancing the bottom line of the company. The symmetrical design of the panels 102 facilitates the efficient use of panel materials during manufacturing, allowing for the reuse of cut portions of panels and enabling the reversal of panels to conceal minor damages, thereby reducing waste and improving cost efficiency in construction. The wall panels 102 may include small roll-formed radii on the panels 102 that add strength and conceal the joints between panels 102 (after panels have been fastened together), creating a seamless look. Further, the wall panels 102 may include grooves 108 that allow for cutting out sections to accommodate electrical boxes, outlets, switches, windows, doors, and other utilities on either the interior or exterior side of the wall panels. The first groove 108 adjacent to the end of each panel 102 may be cut, revealing an inner chase for utilities. These grooves 108 may be spaced apart along a panel both on the exterior and interior surfaces. The grooves 108 may function as guides for cutting tools and enhance the ability for fabricators to accurately make cuts, reducing waste, while adding visual appeal and concealment of the cavity behind. The grooves 108 assist in centering drill bits and/or lasers are necessary for creating holes for water lines, and drains. The grooves 108 also serve as a structural enhancing feature. Each groove 108 is configured to align with exactly half the width of a standard utility box. When corresponding grooves on adjacent panels are cut, they create a perfect dimensional match for utility boxes. It will be appreciated that the grooves 108 provide visual cutting guidance (that provided tactile feedback when a cut-off wheel is centered thereon), ensures dimensional precision, creates a factory-finish appearance, eliminates measurement requirements, and reduces skill requirements for installation.

Figure 3:
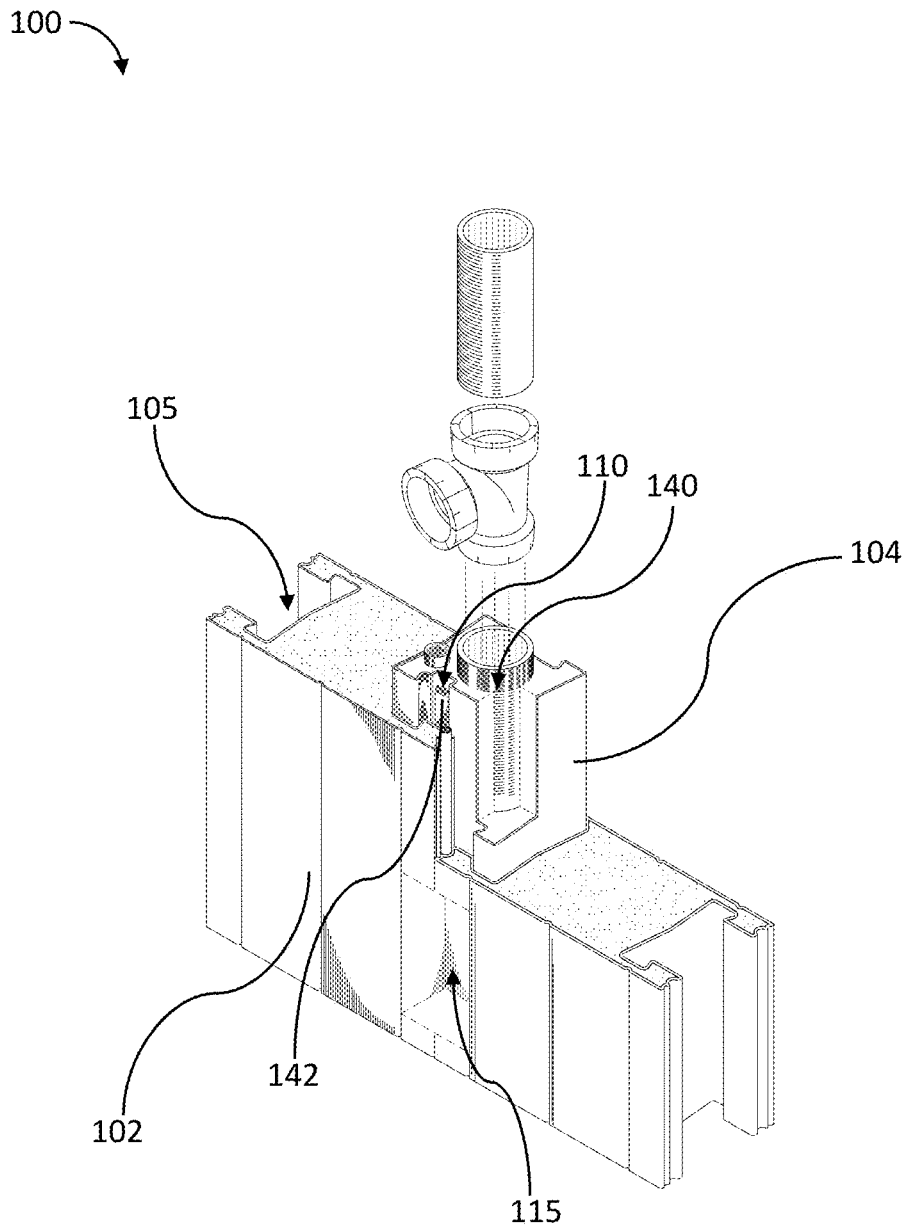
FIG. 3 illustrates a side, top perspective view of a wall building system.
Figure 4:
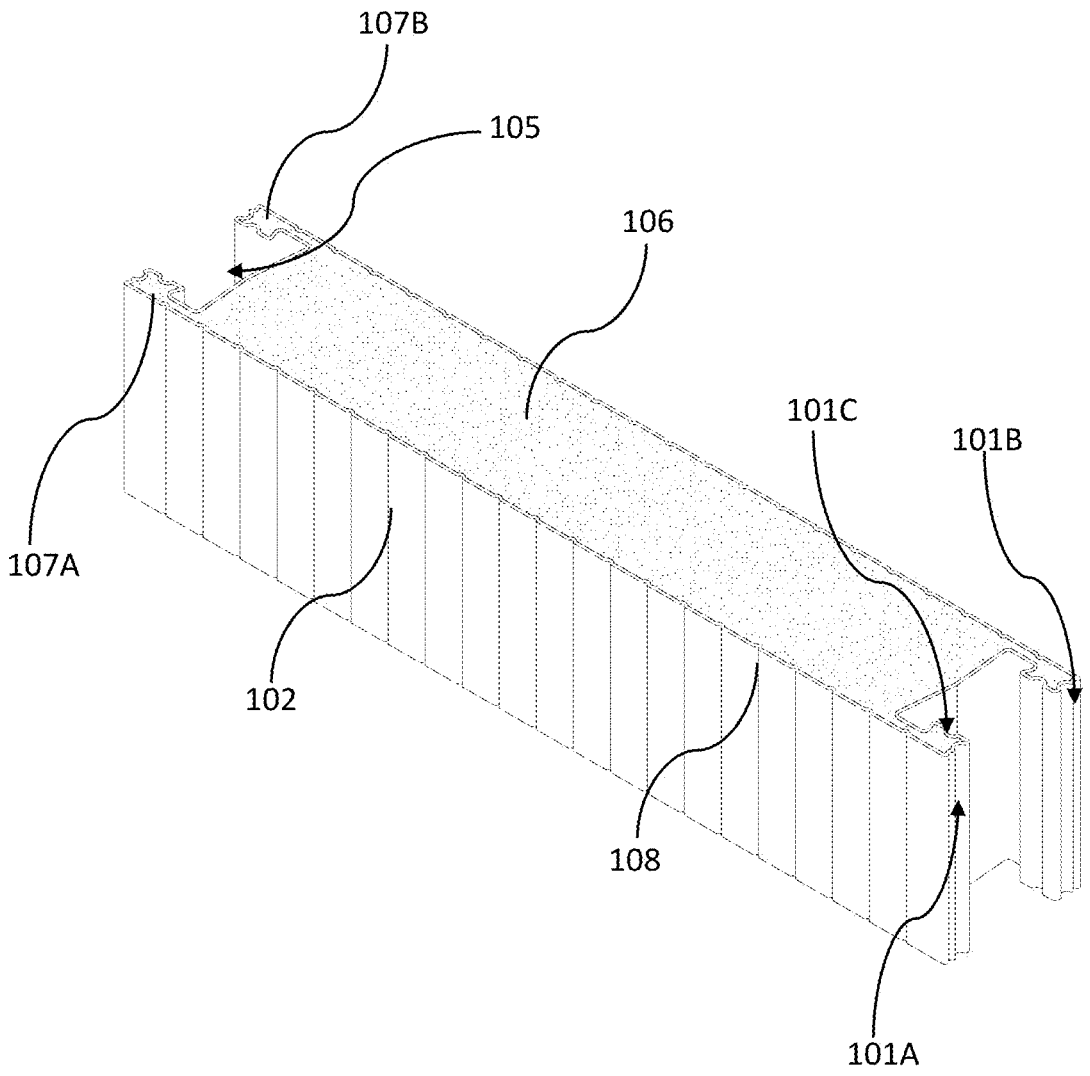
FIG. 4 illustrates a perspective view of a wall panel of a wall building system.
Figure 5:
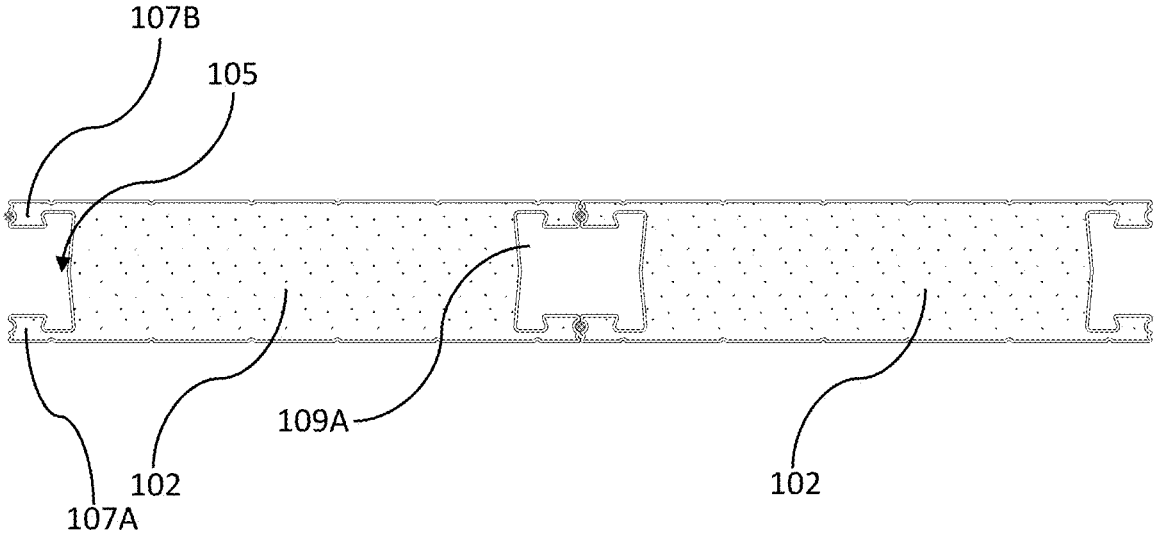
FIG. 5 illustrates a plan view of wall panels and couplers of a wall building system.
Figure 22:
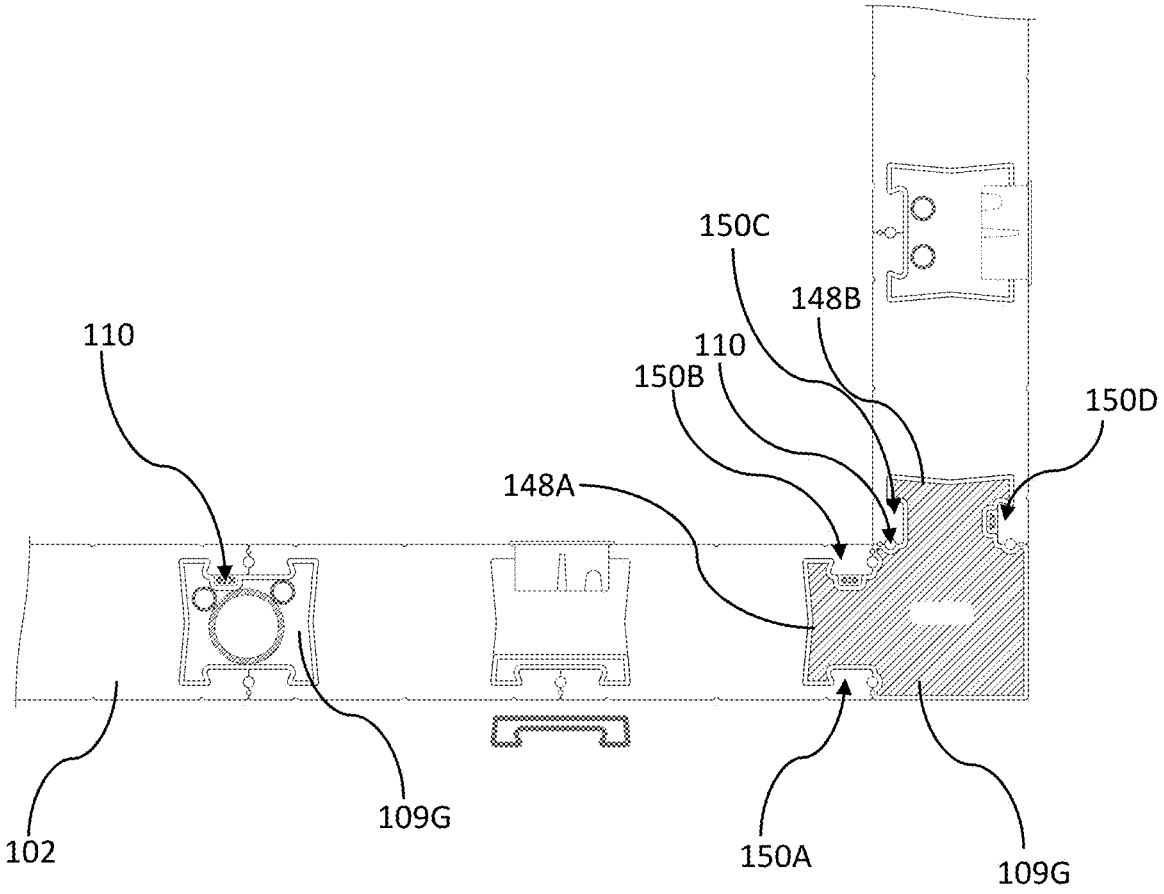
FIG. 22 illustrates a plan view of a wall building system.
Figure 23:
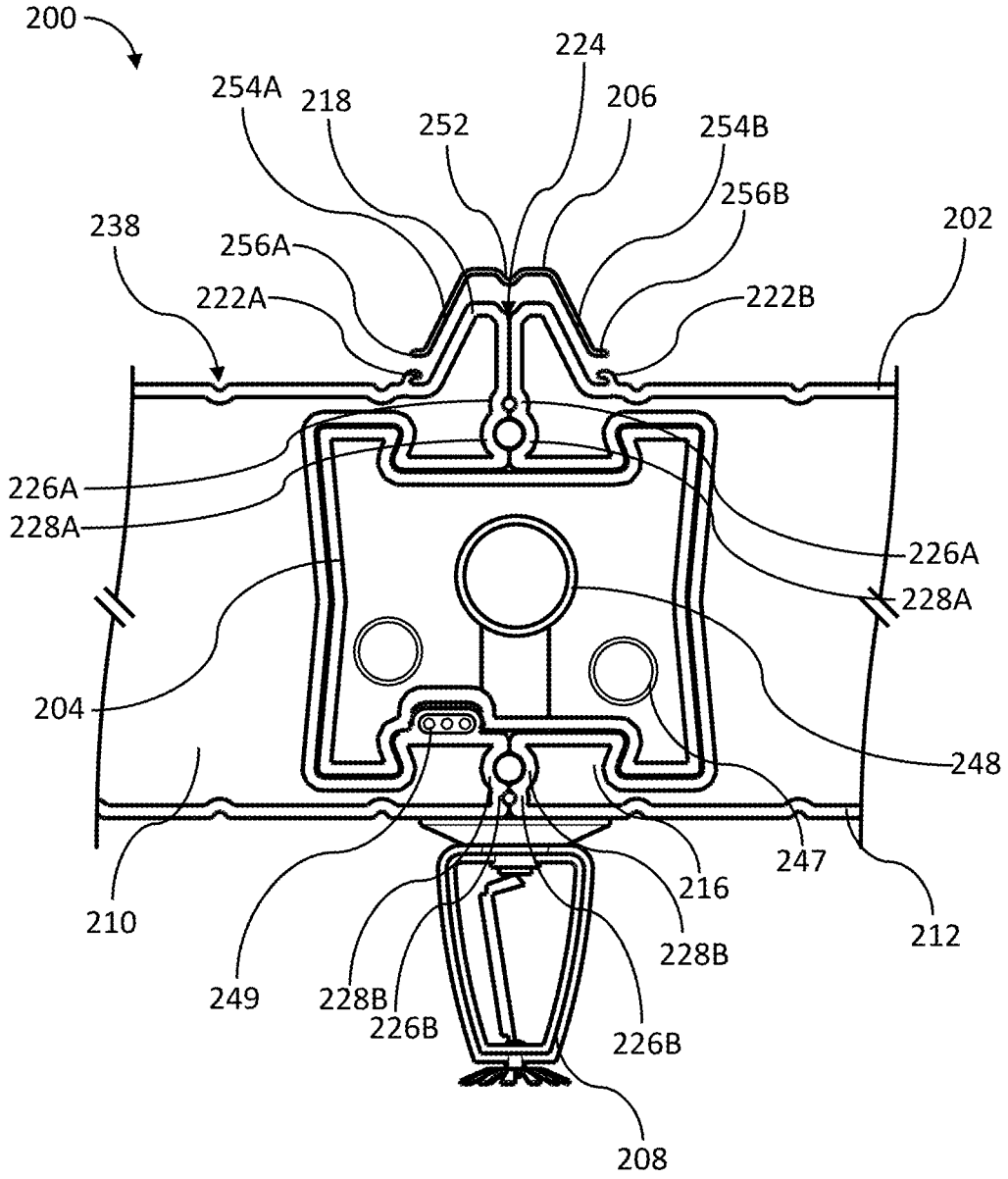
FIG. 23 illustrates a side elevation view of a roof system of a wall building system.
Figure 24:
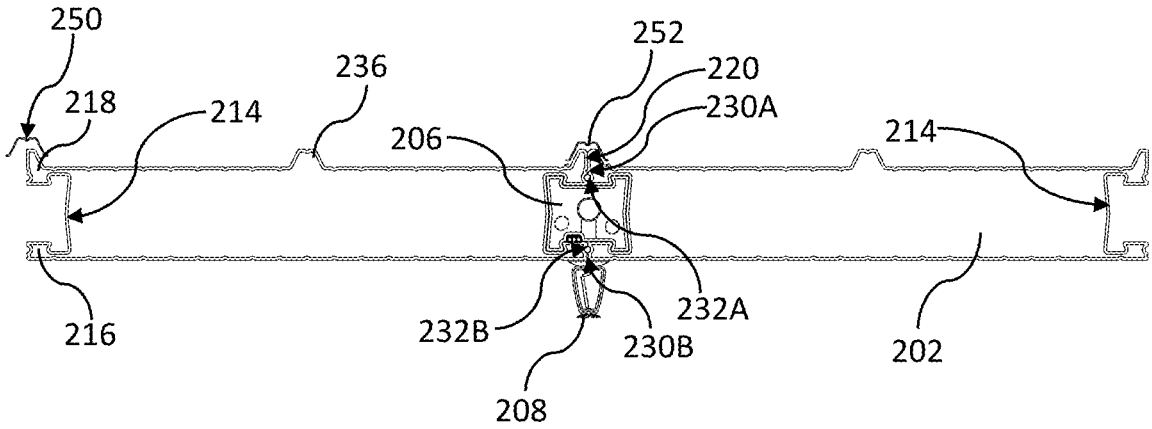
FIG. 24 illustrates a side elevation view of a roof system of a wall building system.
Figure 25:
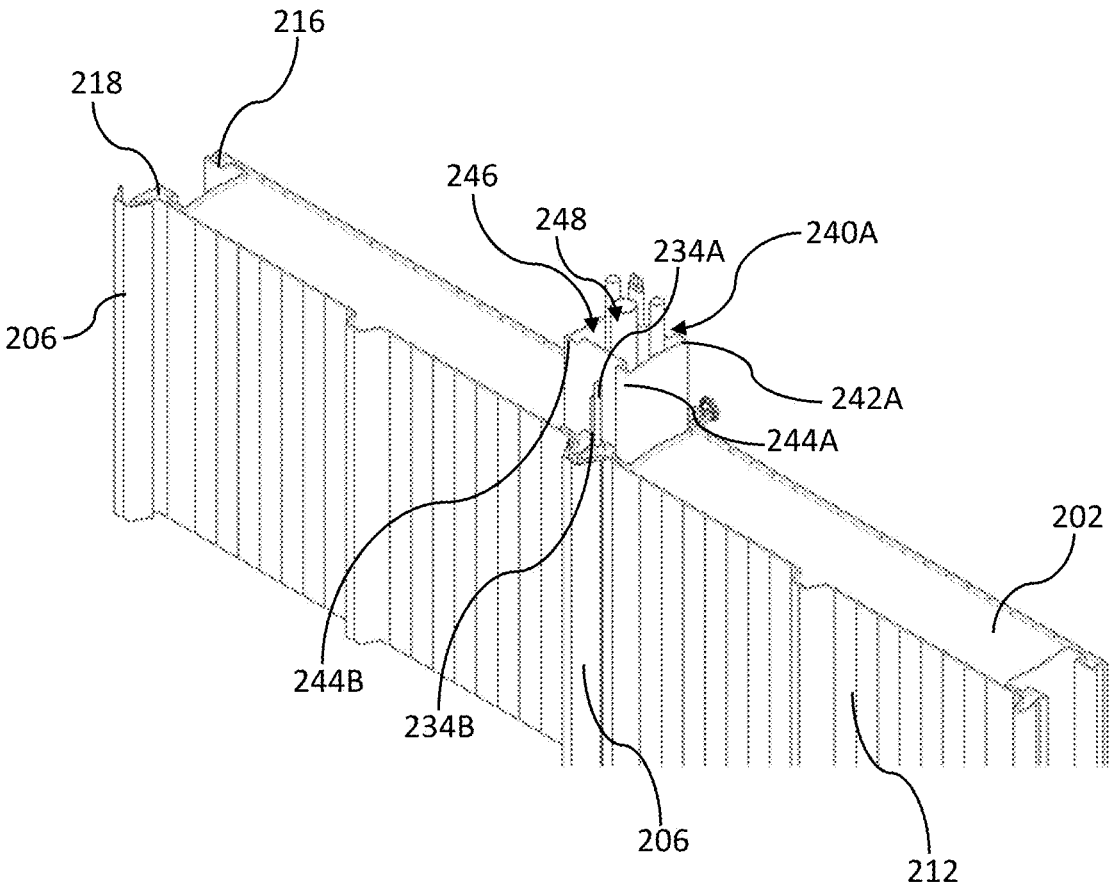
FIG. 25 illustrates a top perspective view of a roof system of a wall building system.
Figure 26:
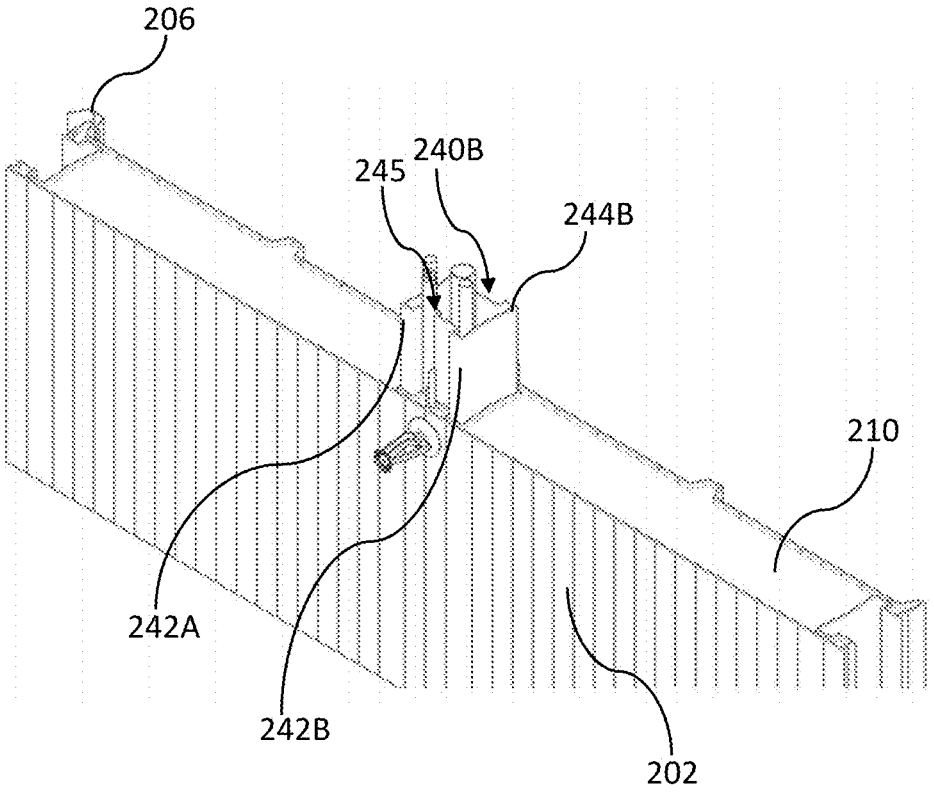
FIG. 26 illustrates a bottom perspective view of a roof system of a wall building system.

The one or more couplers 104 (and, in some, embodiments, extensions) may include standard key couplers 109A (FIG. 6), T-shaped couplers 109B (T key), second T-shaped couplers 109C (second T key), plus-shaped couplers 109D (plus key), a first extension 109E, a second extension 109F, and corner couplers 109G (FIG. 22). It will be appreciated that the one or more couplers 104 may each include cavities 110 that are placed within and/or created at a junction where the panels 102 couple to the one or more couplers 104. The cavities 110 can house utilities, such as electrical wiring and data cables, contributing to the seamless, concealed look of the wall system 100. The cavities 110 may be numerous sizes and shapes to accommodate any wire, cable rod, pipe, etc. Furthermore, the one or more couplers 104 may be cut to receive electrical boxes or any other type of utility. The one or more couplers 104 may be cut with a laser, or any other cutting device, and the rear portion of the one or more couplers 104 after being cut may remain and act as a support. When the one or more couplers are cut, a cut portion 115 that receives the electrical box or other utility is created (FIG. 3). It will be appreciated that any of the one or more couplers 104 may be receive the cut portion 115 or may be configured in any other manner to receive utilities. The one or more couplers 104 can be selectively cut and separated where utility access is needed. The one or more couplers 104 utility channel incorporates unique rotational capability. Further, cut sections can be: separated to create required utility space; rotated/flipped to align with junction box knockouts in any orientation; positioned for either interior or exterior access; structural integrity is maintained due to the engineered design; and multiple access points can be created vertically along the same key.

The one or more couplers 104 may be configured to link parallel wall panels 102. The one or more couplers 104 and any of the other couplers or other components discussed herein may be pultruded fiberglass, or other types of materials known in the art, due to its very high strength, its insulative properties, and ease of manufacturing. The one or more couplers may be made of other types of fiberglass or resin pultrusion, offering superior strength, fire resistance, and thermally advantageous characteristics, as well as being simple to manufacture. In some embodiments, the one or more couplers 104 may be roll formed, extruded in aluminum or plastic, may or may not be filled with polyurethane or PIR, or other filler material. The one or more couplers 104 may be reversible and may be turned upside down. There may be one or more cavities 110 for wire and other utilities, as discussed above. The cavities 110 may be in any of four orientations: front, rear, right or left. If the one or more couplers 104 is turned upside down and rotated, it will expose itself to the other two corners. The one or more couplers 104 may or may not be cut, depending on the application. If it is necessary to install electrical, or data cables, they may be slid all the way from top to bottom and will not be visible from the exterior of the panel 102, unless it is necessary to bring them into the exterior or interior in the case there is a requirement for the utility. In the case a utility is required, the one or more couplers 104 may be easily cut, in which case separating the top and bottom of the one or more couplers 104 as far as is required to allow the accommodation of whatever utility is needed, for instance, an electric outlet. Most electric junction boxes are plastic, and have knockouts in them which allow for the wire (or other utility) to be pushed into the box. But those knockouts are generally on one side on the top, and the other side on the bottom. So, if the one or more couplers 104 is cut, you can alternate the orientation of the cavity to line up with the knockout in the other orientation. If there, it is necessary to have more than one junction box, for instance one on the interior and one on the exterior of the panel in situations where a wall is created inside a building to accommodate numerous outlets inside a building wall, possibly separating a bedroom from a living room, the one or more couplers 104 may be cut in several places, and the orientation of the cavities 110 may be alternated to accommodate this. The strength of the wall 102 is not compromised by having the one or more couplers 104 cut since there will always be several portions of one or more couplers 104 within the wall. The one or more couplers 104 also accommodates the placement of vents, and drain lines. If the one or more couplers 104 is manufactured of extruded aluminum, it may not be filled with polyurethane, and the fact it is hollow would allow for the accommodation of pipe for two or more water lines, gas lines, or additional cables if needed. However, it is also possible to drill holes in keys in which the void was filled with polyurethane in certain situations where enhanced energy efficiency is necessary. It is even possible to accommodate sewer, water, electric outlets/junction boxes, and natural gas or oxygen lines into a single panel; all of which is due to the advanced design of any of the one or more couplers 104. The one or more couplers 104 may be cut and separated to accommodate placement of all utilities. The one or more couplers 104 may be cut, and the lower and upper portions can be rotated or flipped so the wire space can be alternated.

Figure 6:
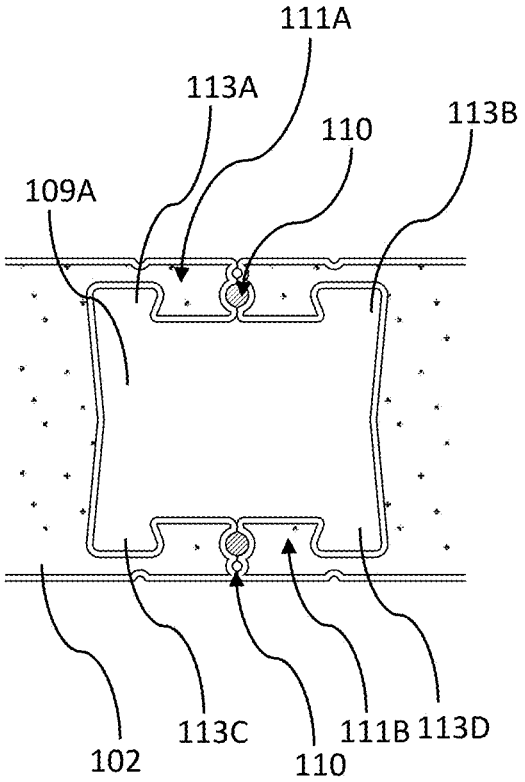
FIG. 6 illustrates a perspective view of a key of a wall building system.
Figure 7:
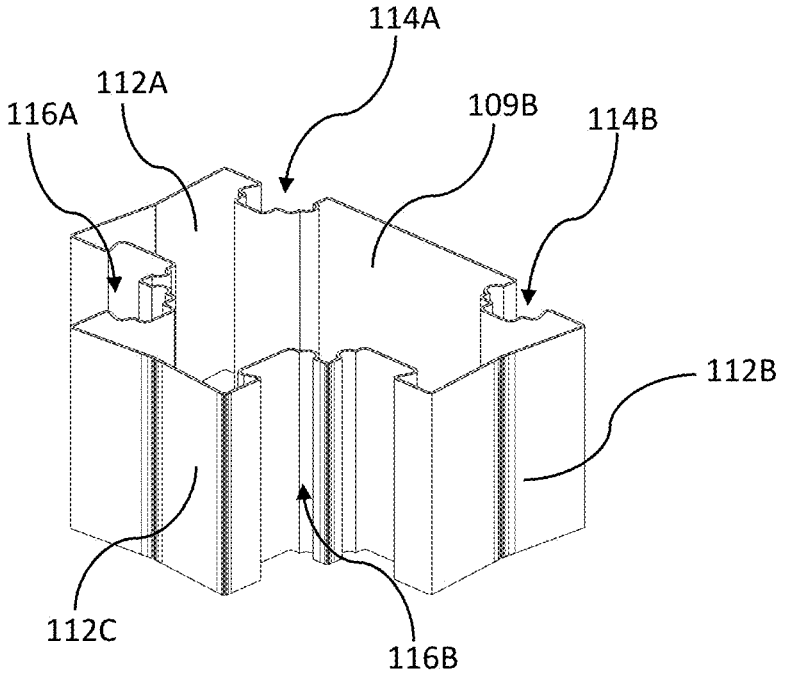
FIG. 7 illustrates a perspective view of a T key of a wall building system.
Figure 8:
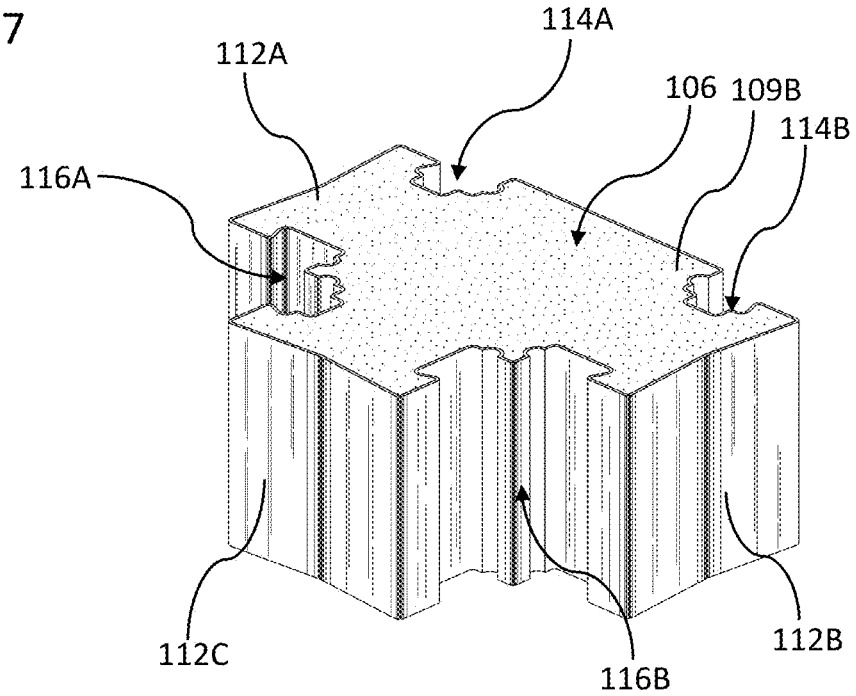
FIG. 8 illustrates a perspective view of a T key of a wall building system.
Figure 9:
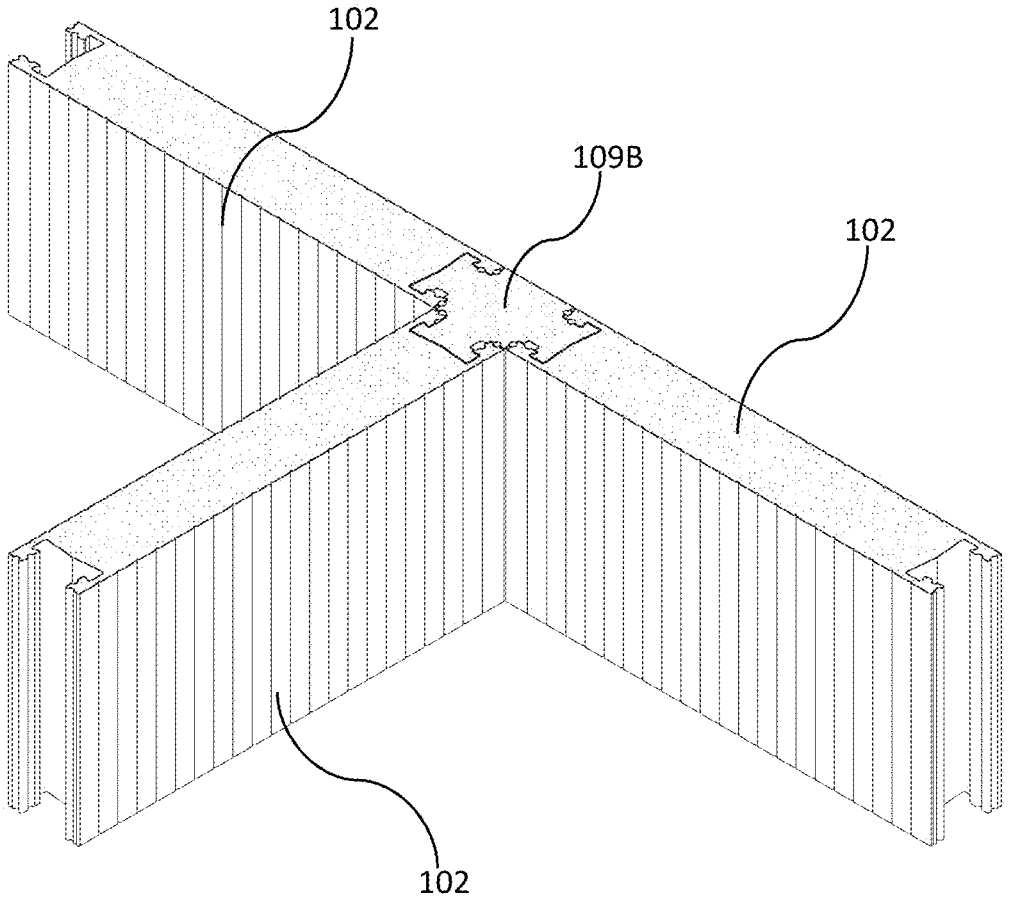
FIG. 9 illustrates a perspective view of wall panels and a coupler of a wall building system.
Figure 10:
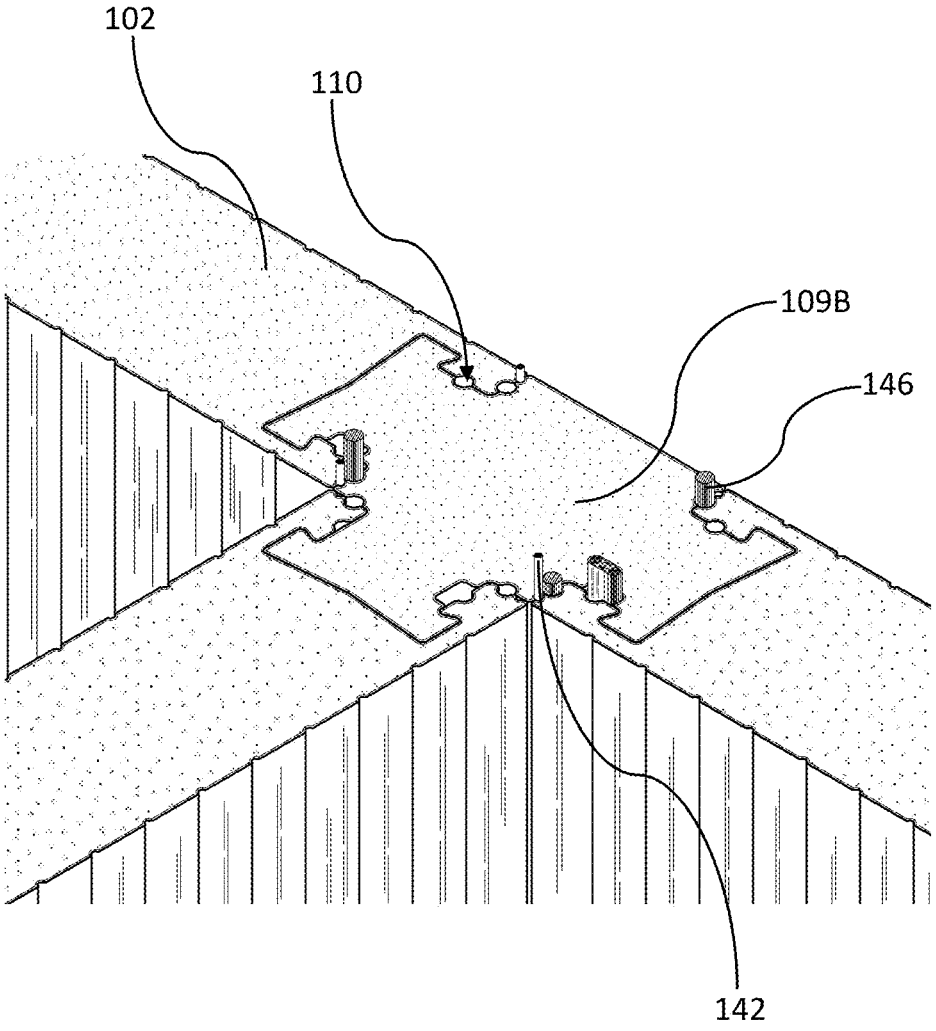
FIG. 10 a perspective view of wall panels and a coupler of a wall building system.

As shown in FIG. 6, the standard key 109A may be generally bowtie-shaped and capable of connecting parallel panels 102. The standard key may include a first recessed portion 111A with a first and second finger 113A, 113B and a second recessed portion 111B with a third and fourth finger 113C, 113D.

Figure 11:
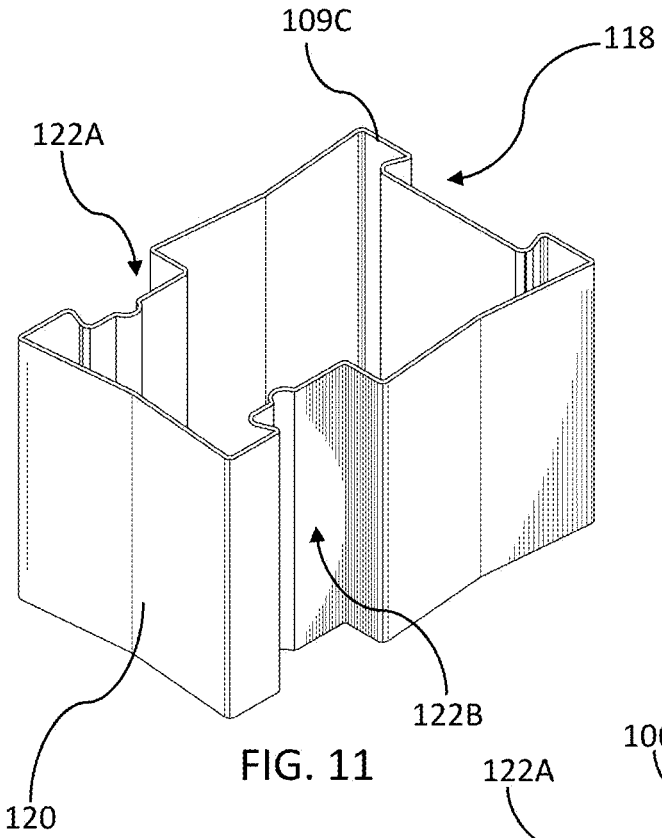
FIG. 11 illustrates a perspective view of a second T key of a wall building system.
Figure 12:
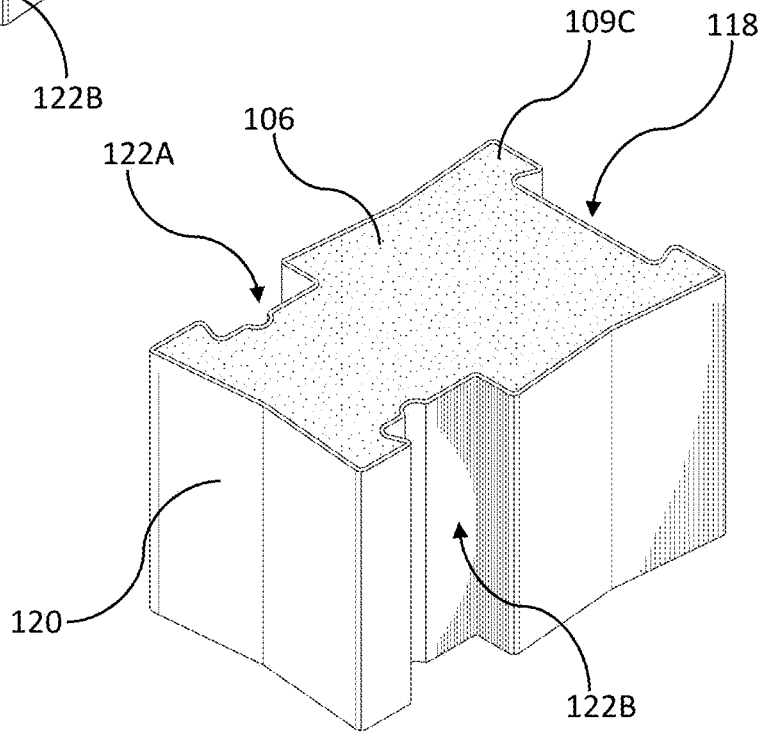
FIG. 12 illustrates a perspective view of a second T key of a wall building system.
Figure 13:
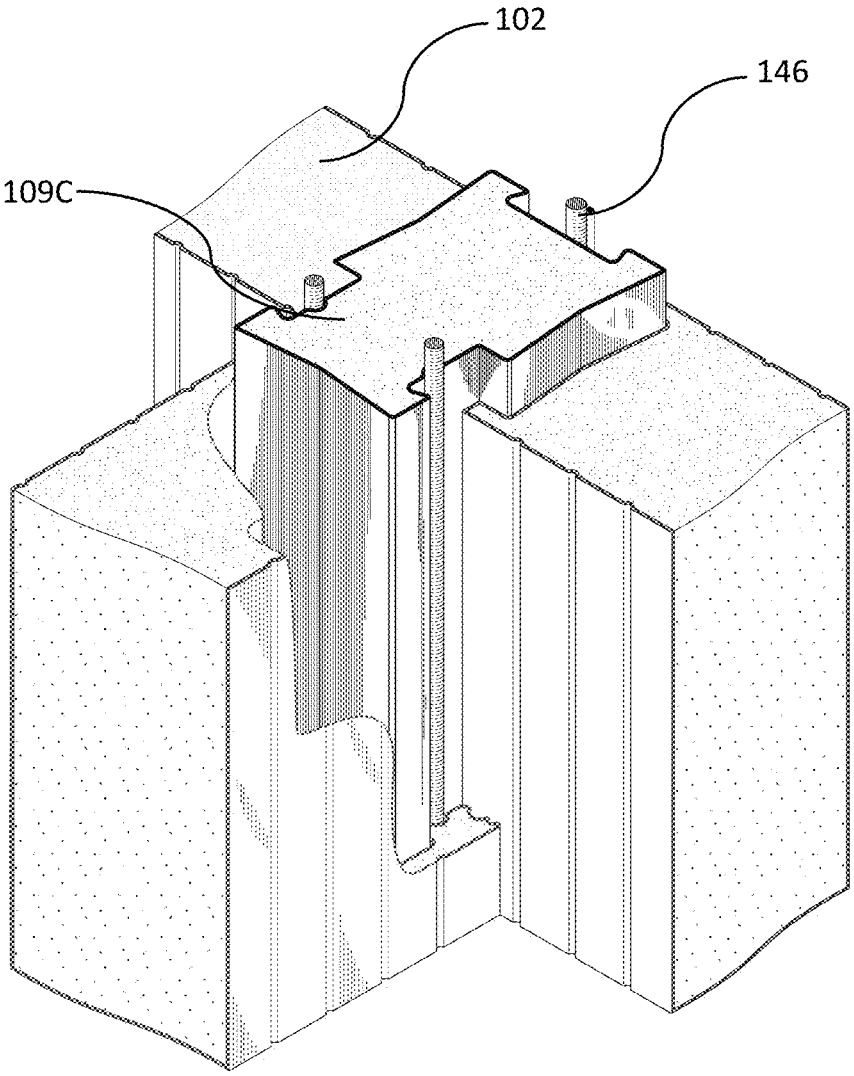
FIG. 13 illustrates a perspective view of wall panels and a second T key of a wall building system.

As shown in FIGS. 7-10, the T-shaped (T key) coupler 109B may be used to join three panels together. In some embodiments, the T Key 109B may be configured to support loft space in factories and doubles as a wall space for attaching shelving. The T key 109B may include a first, a second, and a third member 112A-112C, with each of the members extended from a center of the T key 109B. The T key 109B may have a first slot and a second slot 114A, 114B, both on a rear side of the T key. On a front side of the T key 109B, there may be a first channel 116A and a second channel 116B. The first and second slots 114A, 114B and the first and second channels 116A, 116B may be configured to receive portions of the wall panels 102 (e.g., the recessed portion 105 and the first and second finger 107A, 107B), thereby securing the wall panels 102 to the T key 109B and, thus, to each other. Once the wall panels 102 are coupled to each other via the T key 109B, cavities 110 may be created at the junction of where the wall panels 102 couple to the T key 109B, thereby creating spaces for wires, cables, rods, etc. The material for the T key 109B may be roll-formed steel, extruded aluminum or plastic. One T key may be filled with PU (Polyurethane or other) filler, and the other is hollow. It will be appreciated that the T keys 109B may not have to have polyurethane in them if the building being built does not require a high energy efficiency, or the application may require numerous utilities to travel from one floor to another, or because a large pipe might need to be installed. In some embodiments, as shown in FIGS. 11-13, a second T key 109C may be utilized in the system 100, and may include a first rear slot 118, a first member 120, and a first and second channel 122A, 122B positioned behind the first member 120.

Figure 14:
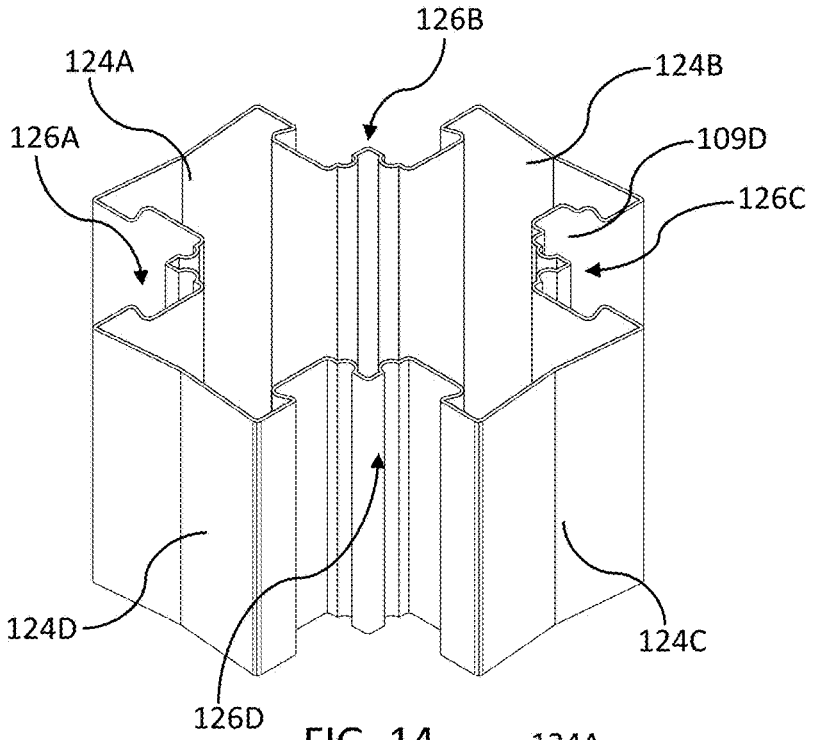
FIG. 14 illustrates a perspective view of a plus key of a wall building system of a wall building system.
Figure 15:
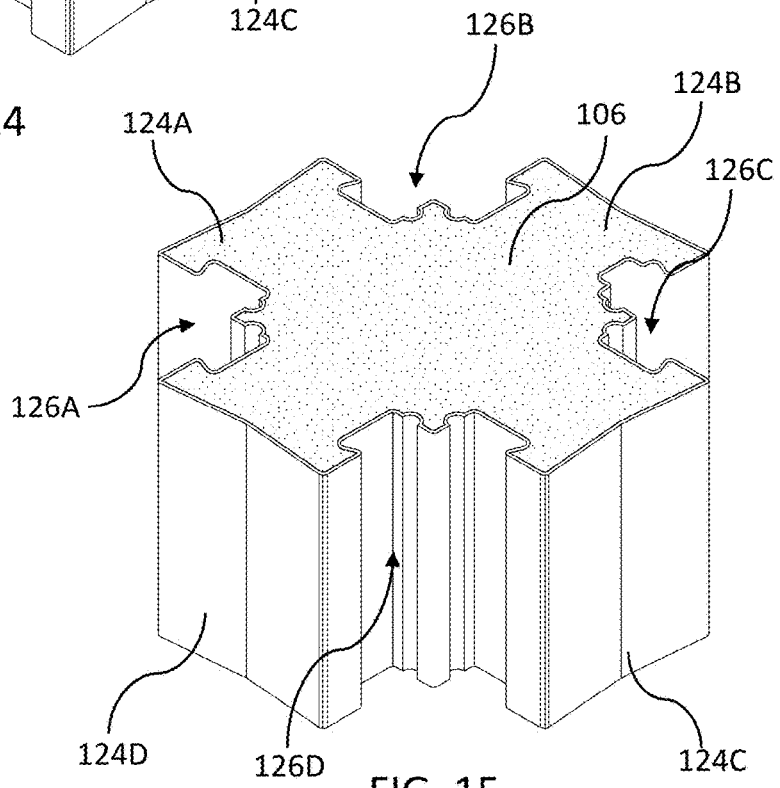
FIG. 15 illustrates a perspective view of a plus key of a wall building system of a wall building system.

As shown in FIGS. 14-15, the plus-shaped coupler (plus key) 109D may be used to connect four walls 102 inside a building. The plus key 109D may include a first, a second, a third, and a fourth member 124A-124D, with each of the members 124A-124D extended from a center of the plus key 109D. The plus key 109D may have a first, a second, a third, and a fourth channel 126A-126D. The channels 126A-126D may be configured to receive portions of the wall panels 102 (e.g., the recessed portion 105 and the first and second finger 107A, 107B), thereby securing the wall panels to the plus key 109D and, thus, to each other. Once the wall panels 102 are coupled to each other via the plus key 109D, cavities 110 may be created at the junction of where the wall panels 102 couple to the plus key 109D, thereby creating spaces for wires, cables, rods, etc. The plus key 109D may have polyurethane (PU) in it. The plus key 109D may be manufactured from roll-formed steel or other materials discussed herein or known in the art. The plus key 109D may be rotated to any four positions.

Figure 16:
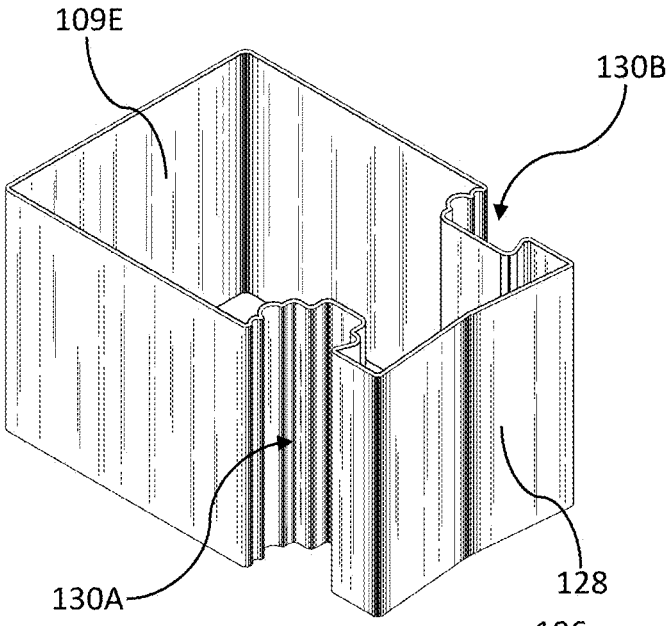
FIG. 16 illustrates a perspective view of a first extension of a wall building system.
Figure 17:
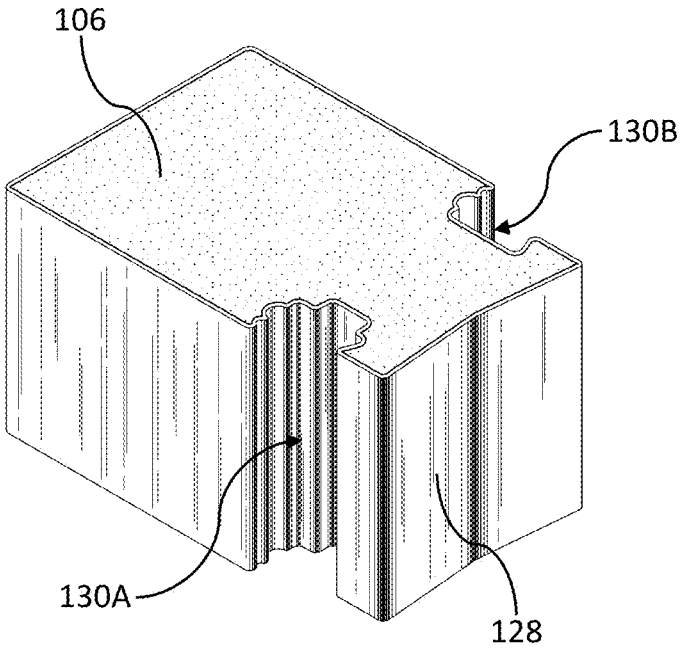
FIG. 17 illustrates a perspective view of a first extension of a wall building system.
Figure 18:
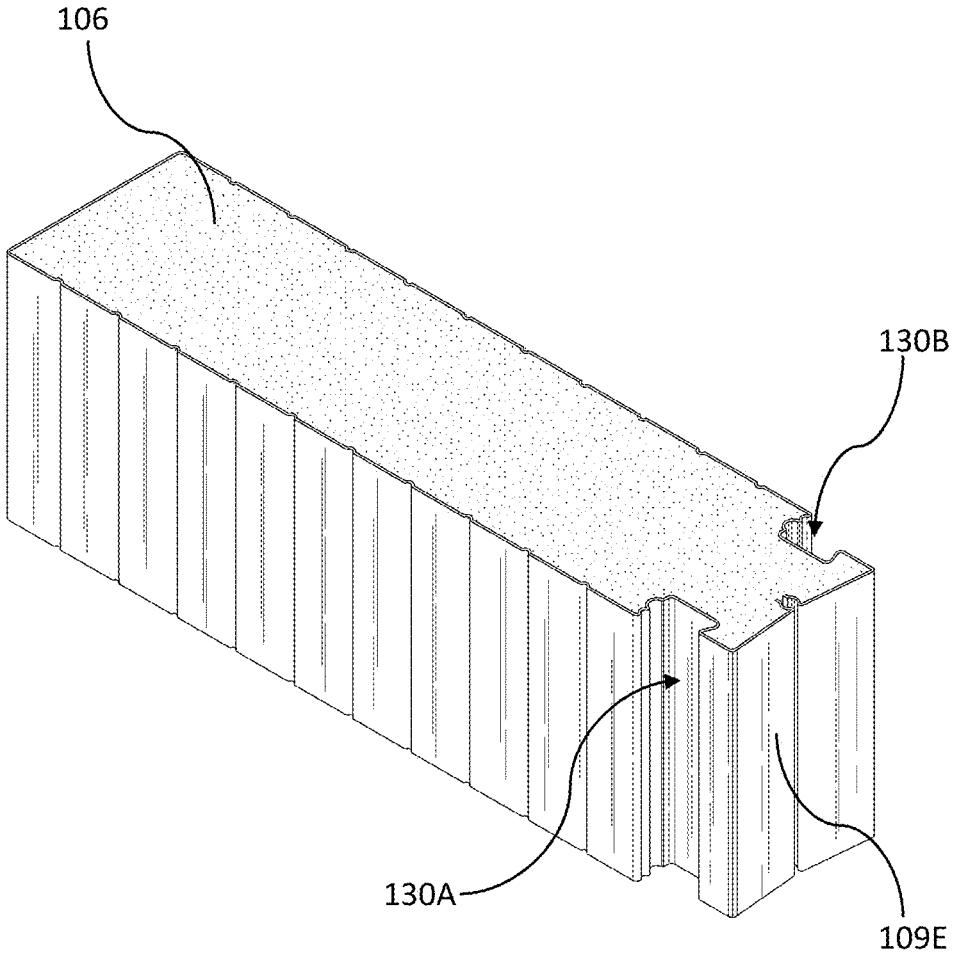
FIG. 18 illustrates a perspective view of a first extension of a wall building system.

As shown in FIGS. 16-18, first extensions 109E (e.g., floor cap) may include a generally square shape, with a first side including a first member 128 extending therefrom, and may be used for doorways, windows, or to incrementally increase the dimensions of the structure. A first slot 130A and a second slot 130B may each be positioned behind and on opposing sides of the first member 128. In some embodiments, the first member 128 may include a groove to receive cables, etc. The first extension 109E may be used to cap a side of the wall panels 102 and/or add length to the wall panel 102, ceiling, and/or floor, when a plus or T key 109B-109D is used. The first extension 109E may be a variety of lengths and may be longer in some instances, such as the roof rake extension shown in FIG. 18. The plus and T key 109B-109D may add about 4" to the length of a wall, and this must be compensated for in another area. It is also used to potentially add 4" increments to panels 102 where a door is installed. For instance, if there is an instance in which two 2' sections of wall are exposed to install a steel door, if the door is 36", the remaining 12" needs to be filled with three extensions. Likewise, if there is a window opening that needs to be filled, it can be made up with a number of these extensions. The first extensions 109E may be filled with PU, in some embodiments.

Figure 19:
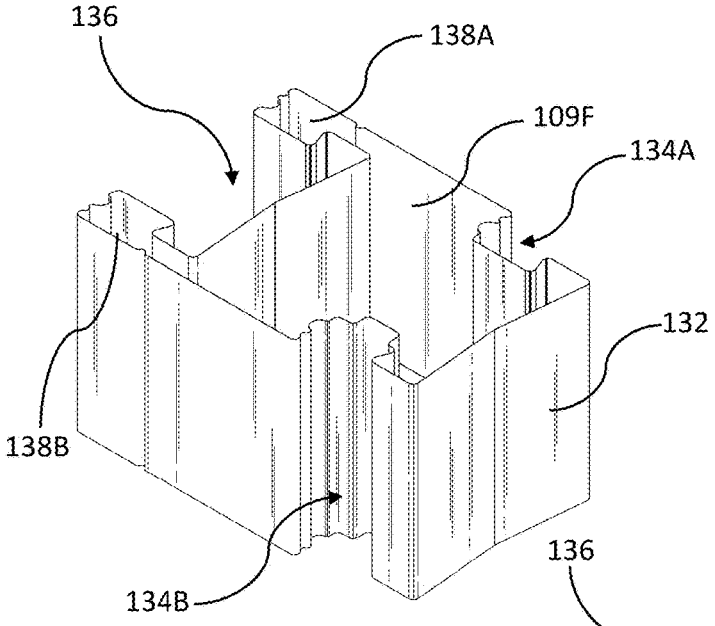
FIG. 19 illustrates a perspective view of a second extension of a wall building system.
Figure 20:
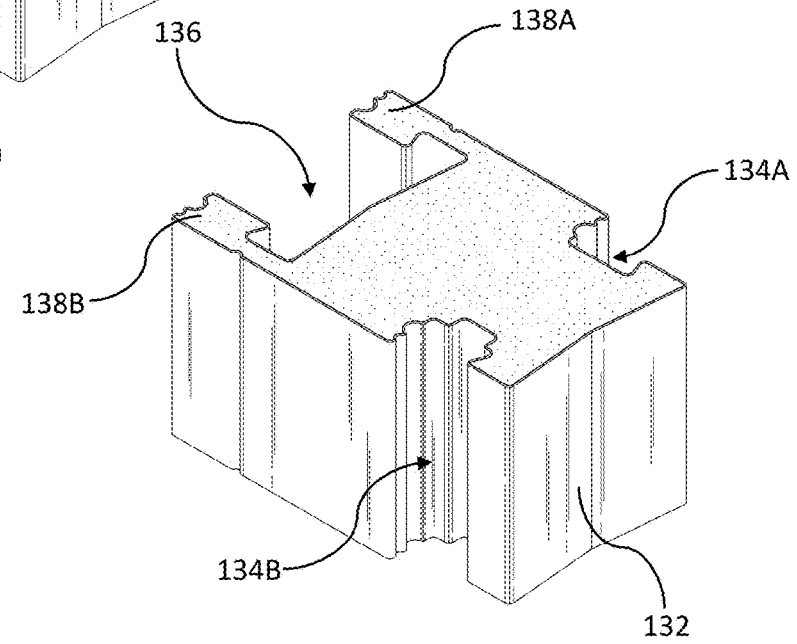
FIG. 20 illustrates a perspective view of a second extension of a wall building system.
Figure 21:
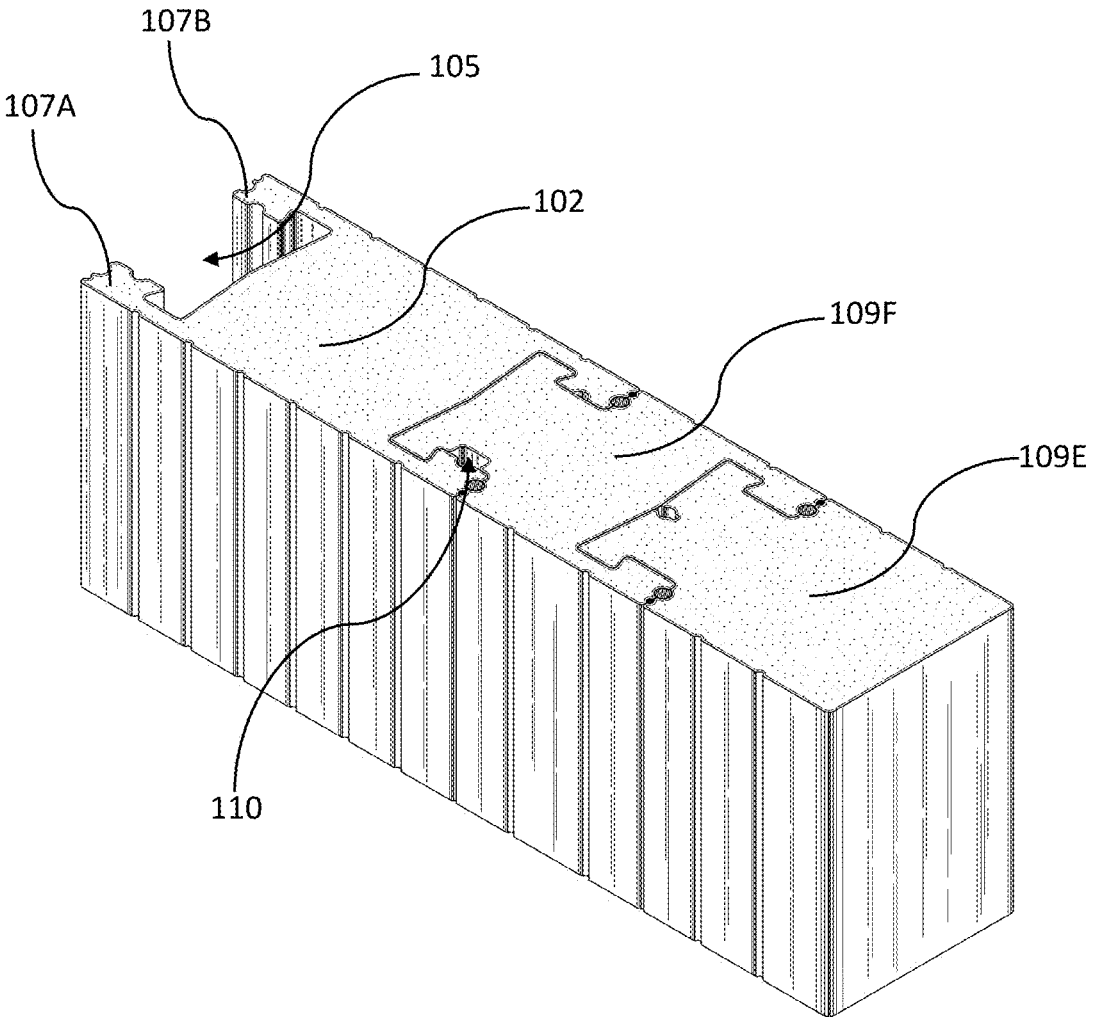
FIG. 21 illustrates a perspective view of a wall panel, a first extension, and a second extension of a wall building system.

As shown in FIGS. 19-21, similarly, second extensions 109F may include a generally square shape, with a first side including a second member 132 extending therefrom. A third slot 134A and a fourth slot 134B may each be positioned behind and on opposing sides of the second member 132. A side opposite the second member 132 may include a member slot 136 with a first wing 138A and a second wing 138B, all of which is configured to match the shape of and mate with the first or second members 128, 132, thereby creating an extended wall panel 102. The first and second extension 109E, 109F may be used to add length to wall panel 102, ceiling, and/or floor, when a plus or T key 109B-109D is used. The second extensions may be filled with PU, in some embodiments. The wall panel 102 may be coupled to the second extension 109F, and the first extension 109E to extend and cap a wall panel 102.

The one or more couplers 104, or any of the other couplers discussed herein, may include one or more holes 140 that accommodates a drain (e.g., an ABS drain), or any other types of pipes.

Referring back to FIGS. 1-3, in some embodiments, the wall building system 100 may include vents 141 placed in the one or more couplers 104 and/or panels 102, wire 142 positioned in the cavities 110, a sealing component 144 (rods, adhesives in liquids or solids, etc.) positionable in the cavities 110 of the one or more couplers 104, and rods 146 positioned on the cavities 110. The vents 141 may be made of PVC or ABS plastic and used to vent sewer gas through the roof. The wire 142 (e.g., Romex) that is used to power electric outlets and lighting. The wire 142 may have two conductors and one ground in the middle. The wire 142 may interact and run along the one or more couplers 104, meaning the wire 142 may be slid all the way from the top of one of the wall panels 102 to the bottom, without being interrupted by other utilities, improving the ease of installation. Other wires may also be placed in the wall panels 102, such as cable, CAT5, fiber optics, or any other data or electric utility. Because any wire interacts with the one or more couplers 104, the wires 142 may run from the top of a wall panel 102 to the bottom, without interruption, and positioned behind the wing of the wall panel 102, being fully concealed. As such, the wires 142 can conduct those electric/data utilities to upper floors, through into a roof panel, or into a floor panel without being seen. The sealing component 144 may be made of liquid polyurethane adhesive, epoxy, or any other sealant whether having a fast or slow cure time. In some embodiments, the sealing component 144 may include the rod 146 (e.g., a plastic rod made of any type of stiff plastic). The sealing component 144 may be configured to prevent leaks, from water, or other contaminates, such as radioactive, biological, wind, and/or odors. It will be appreciated that the sealing component 144 may enhance energy conservation. The sealing component 144 may be either placed in from the top or bottom, if it is a solid piece of metal or plastic, or is injected under pressure from the top or bottom, depending on the requirement of the building being constructed. The sealing component 144 also enhances the strength of the wall panels 102 from lateral damage, and is important in constructing buildings that must be radioactive biohazard proof.

The rods 146 (e.g., plastic) may be positioned outside of the sealing component 144, meaning in a cavity next to a cavity that received the sealing component 144. The rods 146 may be placed everywhere there is the sealing component 144. The rod 146 feature may also be used exclusive of the sealing component 144, if desired. In this situation, the rod 146 would prevent dust or wind from passing it, adding additional design flexibility. The rods 146 may be configured to prevent leakage of the sealant during injection into the cavities 110 created by the one or more couplers 104 past it into the front or rear of the panel 102. The rod 146 may be a failsafe, where the rod 146 and sealing component 144 work hand in hand. The rod 146 is configured to prevent thin adhesives/the sealing component 144 from leaking. A plug is inserted below during assembly of the panel 102 to prevent thin liquids from leaking through to the bottom and onto the floor during manufacture. An integral feature is incorporated into each panel 102 and key 104 which facilitates the injection of the adhesive or sealing component 144. Facilities requiring these additional features might be: biomedical; facilities handling radioactive materials; cleanrooms for semiconductor manufacture; food processing facilities; and facilities handling or researching viruses. When the sealing component 144 and rod 146 work in tandem, the structure becomes safe for any of the aforementioned purposes.

The system 100 may also include an outlet cover that is to cover over a junction box with, for example, a 120 vac GFCI outlet inside it; a water spigot penetrating an exterior wall; and the wing cutout, as discussed above. The wing cutout may be cut with hand or power tools. By cutting out the wing, the interior of the wall panel is exposed, revealing space for utilities. If a portion of the one of the one or more couplers 104 is cut and removed or repositioned, additional space is exposed. There is a groove that lines up with the side of the cutout. This groove is precisely placed to match ½ the width of a standard utility box. When the wing from the other panel is cut in the same place, the utility box perfectly matches the width and height of the box. When the outlet cover is attached, there is a completed factory finish and no gaps are visible. In addition, the wing may be cut to accommodate space for vents or drains or any other type of utility, possibly gas/oxygen lines, natural gas, any number or configuration of liquid lines, fixtures, fittings etc. In addition, the system 100 may be configured to receive pipes, such as water, copper, oxygen, natural gas, other gas, etc. It may also be configured to receive valves (e.g., water valves), vents, drain fittings (the cavity after being exposed from having the key cut and moved out of the way can easily accommodate the fitting). A panel aperture 103B, the groove behind this hole, created by a hole saw, accommodates the PEX water line and ¼ turn valve. The groove is centered in a precise location, allowing for the hole to perfectly accommodate and guide the drill so that it will not deviate from the site, which dramatically improves manufacturability during installation of panels and speeds their installation reducing waste and the skill required, which additionally saves labor costs. PEX water pipe or other pipe, such as copper, oxygen, natural gas, other gas, etc. may be used in the system 100. 120 vac GFCI outlet could be used in the system or replaced with another outlet for any voltage. This space could also accommodate oxygen lines or compressed air, etc.

It will be appreciated that the wall panels 102 are designed to be symmetric on both ends/sides. This symmetry allows the panels to be used interchangeably, flipped, or cut without creating waste, providing flexibility during manufacturing and installation. However, in some embodiment, the wall panels 102 may be different sizes from one to another. Panels 102 are especially useful in factory construction of buildings 14 feet wide up to 52 feet long, and lend themselves to extremely rapid deployment such as in the event of a disaster where a building is required to be factory built but must be built quickly. The unique interlocking key (i.e., one or more couplers) 104 system is a critical component that dramatically speeds up assembly while creating an extremely strong, positive locking joint between the wall panels 102. This key system 104 replaces traditional adhesives and fasteners. While not required, the panel 102 and key 102 design allows for the injection of sealants or adhesives if needed for specific applications like cleanrooms or food manufacturing facilities, in, for example, the holes at the junctions of the wall panels 102 and the one or more couplers 104. The rods 146, as discussed herein, prevent sealant leakage during curing. Further, the system 100 includes different keys 104, such as standard wall keys, corner keys, T-keys for three-way connections, and potentially plus-keys for four-way connections, enabling various wall configurations.

It will be understood that the wall panels 102 and key 104 design facilitate the integration of utilities like water pipes, drains, vents, electrical wiring, and data cables within the internal channels and connection points, concealing them behind the wall panels 102. Furthermore, the system 100 is designed to accommodate and integrate multiple utilities, such as electrical, water supply, and drainage within the same structural wall panel system 100, maximizing efficiency and aesthetics.

It will further be understood that fasteners are not required except at the top and bottom of walls 102, decreasing time of construction. If desired, the panels 102 may be easily disassembled and reassembled. The wall panels 102 and keys 104 are dependent on the other, and the design of the key 104 and panel 102 facilitate delivery of utilities, such as water pipes, fittings, drains and vents, Romex wiring for outlets, etc. Prior to assembly, the key 104 and panel 102 are cut, facilitating the placement of electrical boxes for AC outlets, switches, CAT4 or telephone jacks, fiber optics, or other electric utilities. During assembly, keys/couplers 104 are slid from top and bottom, completing the wall, concealing utilities within. It is possible to have vents, plumbing and electrical within the keys 104 and not see them when looking at the section if there is no necessity to have them exposed, in situations where it is required. Each key 104 has a design feature accommodating installation of Romex wire, CAT5, fiber, cable, or other electric utility. Multiple outlets may be installed on exteriors or interiors of the panels 102, one on top of the other, all within the same panel assembly. Each panel 102 incorporates the ability but not necessity to be cut to expose the utility chase, which are invisible prior to exposure, enhancing the visual appeal as well as ensuring contaminates are not able to propagate from area to area. Accommodating multiple utilities, including electrical, water supply, and drainage, within the same structural building panel system, the system 100 maximizes the utility of the system 100, ensuring that the system 100 is not just limited to electrical utilities but fully integrates all necessary building services in a unified, efficient, and aesthetically pleasing manner.

An example of coupling the system 100 may include the below steps. The first groove on the right or left panel is able to be cut with a jigsaw, or grinder. Prior to assembly of the panels 102, an area/wing is cut to facilitate the placement of an electrical box which can accommodate either an outlet, switch, CAT4 or telephone jack, fiber optics, or other electric utility. The wings that are on every panel, as mentioned, can accommodate an electric box on either the outside or inside of any panel. Once the panels 102 come together, the key 104 is cut, such that enough room is left for the junction box. The panels 102 are put together, and the key 104 is slid in from the top and from the bottom, fastening the panels 102 together. In the case of a junction box, the keys 104 are filled with the insulating core 106 (e.g., polyurethane) for insulation and additional strength. The key 104 is designed such that it has cavities 110 on its exterior, which creates a void between the key 104 and the panel 102. The cavities are specifically designed to accommodate the installation of electric wire 142, CAT5, fiber, cable, or any other electric utility. Therefore, if needed, multiple outlets could be installed on the exterior or interior of the panel 102, one on top of the other. In a factory, where you might have rooms separated by a wall made of the subject panels 102, you would be able to facilitate outlets on both walls, as high or low on the panel as desired, and it would be impossible to see the keys/couplers 104 of the walls by design of the panel 102.

As shown in FIG. 22, the system 100 may also use corner couplers/keys 109G that connect wall panels 102 at a 90-degree angle. The corner couplers 109G may include any of the features of any of the other key/couplers discussed herein. The corner couplers 109G may include a first member 148A with a first and a second slot 150A, 150B and a second member 148B with a third and fourth slot 150C, 150D. The first member 148A and second member 148B interact with and mate with wall panels 102, meaning the recessed portion 105 and fingers 107A, 107B. The first, second, third, and/or fourth slots 150A-150D may include one or more of the cavities 110 to receive electrical or any other type of components to be concealed in the wall panels 102. FIG. 22 illustrates the system 100 with standard couplers 109A and a corner coupler 109G working in tandem to form wall panels 102 at 90 degrees. As shown, electrical boxes, wires, etc. may be integrated with the one or more couplers 104.

As shown in FIGS. 23-26, the wall building system 100 may include a roof system 200. The roof system 200 may include roof panels 202, couplers 204, caps 206, and sprinkler heads 208. The roof panels 202 may be similar in construction to the wall panels 102. The roof panels 202 may include an insulating core 210, such as polyurethane (PU), as a primary filler. In some embodiments, the roof panels 202 may include "Polyisocyanurate" (PIR) due to its superior fire resistance capabilities, structural integrity, and better thermal characteristic. Other insulating cores known in the art may be used therein. The roof panels 202 may include an outer covering 212. The outer covering 212 may include extruded aluminum, plastic, sheetrock, wood, roll-formed, etc. The outer covering 212 would be present on the exterior and/or interior of the roof panel 202 (on both sides of the insulating core 210), and may be filled with polyurethane or other material as previously discussed. In some embodiments, the outer covering 212 of the exterior side of the roof panel 202 may be different than the outer covering 212 material on the interior side of the roof panel 202, or both may be the same material. In some embodiments, the roof panels 202 may be symmetrical, interlocking panels with integrated utility management, structural trim connectors, bottom connector ridge, specialized fasteners, conductive keys, and concealed fire suppression.

Each end of the roof panels 202 may include a recessed portion 214 with a first finger 216 and a second finger 218, all of which interact with and are removably attachable to the couplers 204. The first fingers 216, when in contact with each other, may be parallel to or flush with the outer covering 212. The second fingers 218 may be raised or protrude upward. When the second fingers 218 are mated, they create a conical-like protrusion 220. On both sides of the conical-like protrusion, at a base thereof, may be a first-hooked member 222A and a second-hooked member 222B, both of which are configured to receive and secure the caps 206. A top of the conical-like protrusion 220 may include a notch 224 that receives a portion of the cap 206. The first and second fingers 216, 218 may each include first depressions 226A, 226B and second depressions 228A, 228B that are larger than the first depressions 226A, 226B. These depressions 226A, 226B, 228A, 228B may mate with other depressions 226A, 226B, 228A, 228B on other first and second fingers 216, 218, making first apertures 230A, 230B via the first depressions 226A, 226B and second apertures 232A, 232B via the second depressions 228A, 228B. A sealing component may be placed in the first apertures 230A, 230B. Another sealing component may also be positioned in the second apertures 232A, 232B. The sealing components may be different diameters depending on whether being placed in the first or second apertures 230A, 230B, 232A, 232B. The sealing component may include a rod 234A, 234B (e.g., a plastic rod made of any type of stiff plastic or metal rod), and, in some embodiments, the sealing component may also include an adhesive, or both. The sealing component may be configured to prevent leaks, from water, or other contaminates, such as radioactive, biological, wind, and/or odors. It will be appreciated that the sealing component may enhance energy conservation. The sealing component may be either placed in from the top or bottom, if it is a solid piece of metal or plastic, or is injected under pressure from the top or bottom, depending on the requirement of the building being constructed. The sealing component also enhances the strength of the roof panels from lateral damage, and is important in constructing buildings that must be radioactive or biohazard proof. The rods 234A, 234B may be placed in the first and/or second apertures 230A, 230B, 232A, 232B with or without adhesive. In this situation, the rod 234A, 234B may prevent dust or wind from passing it, adding additional design flexibility. The rod 234A, 234B may be configured to prevent leakage of the adhesive during injection into the apertures. The rod 234A, 234B is configured to prevent thin adhesives from leaking. A plug may be inserted during assembly of the roof panel 202 to prevent thin liquids from leaking.

The roof panels 202 may have a first, upper side, a second, lower side opposite the first side, and the insulating core 210 therein between. The first and second sides may be symmetrical, thereby allowing the user to manipulate the roof panel 202 180 degrees on either the horizontal or vertical axis and have the same results. While the first and second sides are the same, each of the roof panels 202 may be symmetrical from one end to the other and top to bottom. The symmetrical design of the panels 102 facilitates the efficient use of panel materials during manufacturing, allowing for the reuse of cut portions of panels and enabling the reversal of panels to conceal minor damages, thereby reducing waste and improving cost efficiency in construction. On the first, upper side, there may be an upper ridge 236.

Further, the roof panels 202 may include grooves 238 that allow for cutting sections. These grooves 238 may be spaced apart along the roof panel 202 both on the first and second sides. The grooves 238 may function as guides for cutting tools and enhance the ability for fabricators to accurately make cuts, reducing waste, while adding visual appeal and concealment of the cavity behind. The grooves 238 assist in centering drill bits and/or lasers that are necessary for creating holes. The grooves 238 also serve as a structural enhancing feature. It will be appreciated that the grooves 238 provide visual cutting guidance, ensures dimensional precision, create a factory-finish appearance, eliminate measurement requirements, and reduce skill requirements for installation.

The couplers 204 may include a first recession 240A and a second recession 240B, on a top and bottom thereof. The top may include a first member 242A and a second member 242B, both of which extend from the top of the couplers 204. The bottom may include a third member 244A and a fourth member 244B, both of which extend from the bottom of the couplers 204. The first recession 240A may be positioned between the first and second members 242A, 242B. The second recession 240B may be positioned between the third and fourth members 244A, 244B. The coupler 204 may also include a notch 245 for wiring. The couplers 204 are configured to interact with and secure to portions of the first and second fingers 216, 218 and recessed portion 214 of the roof panels 202. The couplers 204 are configured to couple two panels to each other. The couplers 204 may include cavities 246 that are configured to receive pipes 247, wiring 249, etc. Furthermore, the cavities 246 may house a fire suppression system 248 with sprinkler heads 208 that complies with NFPA 13, NFPA 13D, NFPA 13R standards, and relevant building codes for fire suppression in concealed spaces, including requirements for activation, obstruction prevention, and smoke control. The couplers 204 may be configured to link roof panels 202. The couplers 204 and any of the other couplers or other components discussed herein may be pultruded fiberglass, or other types of materials known in the art, due to its very high strength, its insulative properties, and ease of manufacturing. The couplers 204 may be made of other types of fiberglass or resin pultrusion, offering superior strength, fire resistance, and thermally advantageous characteristics, as well as being simple to manufacture. In some embodiments, the couplers 204 may be roll formed, extruded in aluminum or plastic, may or may not be filled with polyurethane or PIR, or other filler material.

In some embodiments, the couplers 204 may include trim fasteners (ridge, rake, angled) provide flashing and load bearing. These trim fasteners provide waterproofing, sealing, load transfer, and attachment points. A ridge connector spans roof peaks, with flashing flanges overlapping panels and structural legs engaging keys for load bearing. A bottom ridge ties walls to floors with dual flanges, weep holes, and interior trim. In some embodiments, a fastener, with hex head, hollow shank, and serrated tip cast from zinc or Zamak, secures hardware without delamination.

The caps 206 may include an upper portion with an indent 250, thereby creating a ridge 252 that may be placed in the notch 224 on the conical-shaped protrusion 220. The caps 206 each include a first leg 254A and a second leg 254B on opposite sides of the upper portion. The legs 254A, 254B may extend downward and outward as they travel from the upper portion to a lower portion. The first and second legs 254A, 254B may include a first digit 256A and a second digit 256B, respectively. Additionally, the first and second digits 256A, 256B may be positioned under the first- and second-hook members 222A, 222B, securing the caps 206 to the roof panels 202 and aiding in fastening each panel together. The caps 206 are configured to generally match the shape of the conical-like protrusion 220. The caps 206 lock adjacent roof panels 202 while providing a self-draining seal to prevent water infiltration. The features of the roof system 200, similar to the wall-building system 100, enable tool-free assembly, superior waterproofing, and concealed fire suppression integration within key cavities, distinguishing the roof from wall panels by addressing slope-specific challenges like gravity-fed drainage and wind uplift.

It will be understood that while various embodiments have been disclosed herein, other embodiments are contemplated. Further, systems and/or methods according to certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure.

What is claimed is:

1. A roof system comprising:

removably attachable roof panels that are coupled together to create a roof;

couplers that fasten each of the removably attachable roof panels to each other;

wherein the removably attachable roof panels and the one or more couplers receive and conceal electrical and plumbing components;

wherein ends of the removably attachable roof panels each comprise a recessed portion with a first finger and a second finger on opposite sides of the recessed portion, the first and second fingers each comprise first depressions and second depressions;

wherein when the second fingers on two of the removably attachable roof panels are mated, a protrusion is created.

2. The wall building system of claim 1, wherein the removably attachable panels comprise an insulating core interposed between outer coverings.

3. The wall building system of claim 1, wherein a first-hooked member may be positioned at a first side of a base of the protrusion and a second-hooked member may be positioned at a second side of the base of the protrusion.

4. The wall building system of claim 1, further comprising caps that assist in securing the removably attachable roof panels together.

5. The wall building system of claim 1, wherein the removably attachable roof panels each comprise a ridge.

6. The wall building system of claim 1, wherein when the first fingers and the second fingers on two of the plurality of removable attachable roof panels are mated, first and second apertures are created.

7. The wall building system of claim 6, wherein a sealing component is placed in the first apertures and the second apertures.

8. The wall building system of claim 1, wherein pipes are positioned in the couplers.

9. The wall building system of claim 1, further comprising wiring positioned between one of the couplers and one of the removably attachable roof panels.

10. The wall building system of claim 1, wherein the couplers comprise a fire suppression system.

11. The wall building system of claim 1, further comprising outer coverings on the removably attachable roof panels, the outer coverings comprising spaced apart grooves.

12. A roof system comprising:

removably attachable roof panels that are coupled together to create a roof, the removably attachable roof panels comprising:

a first side with a first outer covering, a second side with a second outer covering, and a core interposed between the first and second outer coverings, first and second fingers at each end of the roof panels;

wherein ends of the removably attachable roof panels each comprise a recessed portion with the first finger and the second finger on opposite sides of the recessed portion, the first and second fingers each comprise first depressions and second depressions;

wherein when the second fingers on two of the removably attachable roof panels are mated, a protrusion is created;

couplers that fasten each of the removably attachable roof panels to each other, the couplers comprising:

a first member, a second member, a first recession interposed between the first member and the second member, a third member, a fourth member, and a second recession interposed between the third member and the fourth member.

13. The wall building system of claim 12, further comprising caps.

14. The wall building system of claim 12, wherein the first side of each of the removably attachable roof panels comprise a ridge.

15. The wall building system of claim 12, wherein the couplers comprise a fire suppression system, wire, and pipes.

16. The wall building system of claim 13, wherein the caps comprise arms and digits that interact with the second fingers on the removably attachable roof panels.

17. A roof system comprising:

removably attachable roof panels that are coupled together to create a roof, the removably attachable roof panels comprising:

a first side with a first outer covering, a second side with a second outer covering, and a core interposed between the first and second outer coverings, first and second fingers at each end of the roof panels; wherein hooked members are positioned at the base of the second fingers;

couplers that fasten each of the removably attachable roof panels to each other, the couplers comprising:

a first member, a second member, a first recession interposed between the first member and the second member, a third member, a fourth member, and a second recession interposed between the third member and the fourth member;

caps that are placed at the junction of two removably attachable roof panels, the caps comprising:

an upper portion with a ridge, a first leg and a second leg descending from opposite sides of the upper portion, a first digit on the first leg distally from the upper portion, a second digit on the second leg distally from the upper portion, wherein the first and second digit are positioned underneath the hooked members to secure the caps to the removably attachable roof panels, wherein the removably attachable roof panels and the one or more couplers receive and conceal electrical and plumbing components.

* * * * *